US005102121A

United States Patent [19]

Solow et al.

[11] Patent Number: 5,102,121

[45] Date of Patent: Apr. 7, 1992

[54] DEVICE FOR LIMITING THE RANGE OF MOTION ON WEIGHT-LIFTING MACHINES

[75] Inventors: Howard J. Solow; Robert J. Wentzel, both of Nesconset, N.Y.

[73] Assignee: Lumex, Inc., Bay Shore, N.Y.

[21] Appl. No.: 593,495

[22] Filed: Oct. 3, 1990

Related U.S. Application Data

[63] Continuation of Ser. No. 310,045, Feb. 10, 1989, abandoned.

[51] Int. Cl.[5] ..... A63B 21/06

[52] U.S. Cl. ..... 482/94; 482/137

[58] Field of Search ..... 272/117, 118, 123, 134; 128/25 R

[56] References Cited

U.S. PATENT DOCUMENTS

| | | | |
|---|---|---|---|
| 3,856,297 | 12/1974 | Schnell | 272/117 X |
| 4,199,139 | 4/1980 | Mahnke et al. | 272/118 |
| 4,200,279 | 4/1980 | Lambert, Jr. | 272/118 |
| 4,311,305 | 1/1982 | Lambert, Jr. et al. | 272/118 |
| 4,411,424 | 10/1983 | Barnett | 272/118 |
| 4,422,636 | 12/1983 | De Angeli | 272/134 X |
| 4,515,363 | 5/1985 | Schleffendorf | 272/118 |
| 4,621,807 | 11/1986 | Stramer | 272/118 |
| 4,709,920 | 12/1987 | Schnell | 272/117 |
| 4,709,922 | 12/1987 | Slade, Jr. et al. | 272/117 X |
| 4,763,897 | 8/1988 | Yakata | 272/134 X |
| 4,793,608 | 12/1988 | Mahnke et al. | 272/134 X |
| 4,836,536 | 6/1989 | Jones | 272/134 |
| 4,842,271 | 6/1989 | Vinciguerra | 272/118 |

OTHER PUBLICATIONS

Advertisement by Eagle Fitness Systems.

Badger Machine—Undated Marketing Brochure.

Nautilus Machine—Undated Marketing Brochure.

Polaris Machine—Undated Marketing Brochure.

Body Master Machine—Undated Advertisement.

*Primary Examiner*—Robert Bahr

*Attorney, Agent, or Firm*—Davis Hoxie Faithfull & Hapgood

[57] ABSTRACT

A range-limiter device for a weight machine. An input assembly which rotates in response to a force exerted by the user is fixed to a shaft supported on the frame of the machine. A cam is also fixed to the shaft. Two parallel arms are supported on the shaft. Mounted on substantially the entire perimeter of the cam is a cam track. A cam follower surrounds the cam track. One end of a cable is secured to the cam follower. The cable wraps around the perimeter of the cam in the cam track grooves and leaves the cam track tangentially and travels to a pulley system terminating at a weight stack of the machine. Two features of the cam follower are captured in slots on the interior surfaces of the parallel arms. To adjust the start position for the range of motion of the input assembly, the user disengages a pull pin from the hole in the cam thereby disconnecting the parallel arms from the cam. This results in disconnecting the cable from the cam. The user then rotates the input assembly and cam to the desired start position. Once the adjustment is completed, the pull pin is engaged in the appropriate hole in the cam. This essentially reconnects the cable to the cam and allows the user to engage in the desired exercise or rehabilitation protocol.

21 Claims, 14 Drawing Sheets

DEVICE FOR LIMITING THE RANGE OF MOTION ON WEIGHT-LIFTING MACHINES

This is a continuation of copending application Ser. No. 07/310,045 filed on Feb. 10, 1989, now abandoned.

FIELD OF THE INVENTION

This invention relates to a device for limiting the range of motion on weight-lifting machines, particularly on selectorized variable-resistance weight machines.

BACKGROUND OF THE INVENTION

So-called selectorized weight machines have been used in fitness clubs and athletic training facilities for many years. These machines allow the user to select the amount of weights on a weight stack which will be lifted during the exercise or training protocol.

A specialized version of a selectorized weight machine is one which allows for variable resistance along the range of motion of the exercise or training protocol. These selectorized variable-resistance weight machines utilize a cam having a varying radius or cam profile. Cable means of some kind, such as an actual wire cable, a chain, a belt or the like, is attached at one end to a weight stack and is attached at the other end to the cam. When the user rotates an input assembly fixed to the cam, the cam rotates and winds up the cable, chain, etc., thereby lifting the weights from the weight stack. The changing cam profile varies the mechanical advantage of the weights which the user encounters. The cam profile is designed to approximate the change in anatomical mechanical advantage of the user at each point in the range of motion.

Ideally, when the user is at a "weak" point in his or her range of motion, i.e., when the user is at an anatomical point in the range of motion where the user is unable to lift much weight, the cam profile will match this weakness by minimizing the mechanical advantage which the weight stack has on the user.

Similarly, the cam profile is designed to modify the mechanical advantage of the weight stack in an appropriate fashion when the user is at a "strong" point in the anatomical range of motion. In this case, the cam profile will maximize the mechanical advantage which the weight stack has on the user.

The varying radius of the cam profile is an attempt to approximate an ideal situation where the user is lifting as much weight as he or she can at each point in the user's range of motion.

The "selectorized" aspect of selectorized variable-resistance weight machines allows the user to select varying number of weight plates from the weight stack. This is usually accomplished by inserting a pin into one of the plates.

Selectorized variable-resistance weight machines are well known in the industry, for example, those prior models made by EAGLE® Fitness Systems by Cybex (an unincorporated operating division of the assignee of the present application) and Nautilus Sports Medical Co.

Selectorized variable-resistance weight machines are also used in the rehabilitation field, as well as for exercise and training. For rehabilitation purposes, it is often important to limit the range of motion the patient is allowed to go through on the machine during the rehabilitation protocol. For example, after certain knee injuries, it is important that the patient avoid loading muscles with weights at certain points in the range of motion for knee extension. However, for other points in the range of motion for knee extension, use of a weight machine may play an important part in the rehabilitation protocol.

Selection of an appropriate start and stop point in the range of motion can be critical in the rehabilitation setting. Injury may result if the patient loads his or her limb with weights from the weight stack at an undesired position in the range of motion. Sports medicine and rehabilitation physicians and physical therapists have long recognized that there are certain safe ranges of motion for rehabilitation of particular injuries, and that use of selectorized variable-resistance weight machines outside of those ranges can be dangerous to the patient.

In the exercise and training fields, there are also advantages to narrowing the allowed range of motion in weight training. For example, athletes sometimes concentrate on developing muscle strength and bulk over limited specified, ranges of motion.

Prior art means for limiting the range of motion on selectorized variable-resistance weight machines have generally fallen into two categories. In both categories, the stop or end position for the range of motion is accomplished by adjusting the location of a stop pin or a block such that the input assembly or rotating member of the machine hits the pin or block at the desired stop point in the range of motion.

The difference between the two categories of prior-art machines relates to the manner in which the start position for the desired range of motion is accomplished.

In the first category, the user, clinician or therapist rotates the input assembly or rotating member of the machine to the desired start location, thereby also lifting the weights. The user, clinician, etc. inserts a mechanical stop against which the input assembly or rotating member rests.

This first category of machines has the obvious disadvantage that the weight stack must be lifted in order to make the adjustment, and a mechanical stop must be put in place after each adjustment is made.

The second category of machines disconnects the input assembly or rotating member from the weight stack and cam before the adjustment of the start position is made. This is done, for example, by use of a clutch or pull pin. This has major disadvantages when used with a variable-resistance weight machine. Once the input assembly or rotating member is reoriented with respect to the cam on a variable-resistance machine, the changes in the anatomical mechanical advantage of the user and the changes in the cam mechanical advantage are no longer synchronized. Depending on the particular exercise, training or rehabilitation protocol (e.g., leg curl, arm curl, shoulder press, etc.) the maximum cam effect could occur at the user's weakest point of anatomical advantage, resulting in a risk of injury to the user.

There remains a need on variable-resistance weight machines for a range-limiter device which does not require that the weight stack be lifted to make a start-position adjustment nor requires reconfiguring the relationship between the anatomical mechanical advantage of the user and the cam profile to make such an adjustment.

SUMMARY OF THE INVENTION

The method of the present invention provides for adjusting the start position for the range of motion on a weight machine. The machine has a frame, weight loading means, cable means attached at a first end to the weight loading means, a shaft rotatably supported on the frame, a cam fixed to the shaft, an input assembly fixed to the shaft, the input assembly engaging the user's limbs, and connecting means for connecting a second end of the cable means to the cam.

The steps of the method include disconnecting the second end of the cable means from the cam, rotating the input assembly and the cam to the desired start position in the range of motion and then reconnecting the second end of the cable means to the cam.

The range-limiter device of the present invention is used on a weight machine having a frame, weight loading means and cable means attached at a first end to the weight loading means. The device itself comprises a shaft supported on the frame, a cam fixed to the shaft, an input assembly fixed to the shaft, the input assembly engaging the limbs of the user, cable supporting means fixed to a second end of the cable means and first connecting means for connecting the cable supporting means to the cam, wherein to adjust the start position for the range of motion of the input assembly the user disconnects the cable supporting means from the cam, rotates the input assembly and the cam to the desired start position and then reconnects the cable supporting means.

The range-limiter device of the present invention allows for adjustment of the start position for the range of motion without the need to lift the weight loading means. Further, the start-position adjustment does not reorient the relationship between the anatomical mechanical advantage of the user and the cam mechanical advantage.

DETAILED DESCRIPTION OF THE INVENTION

The preferred embodiment of the device of the present invention is shown in FIGS. 1-12. In this embodiment, adjustment of the start position for the range of motion is made by disconnecting a cam of the variable-resistance weight machine from a cable means attached to a weight stack on the machine. This embodiment also is the preferred embodiment for the method of the present invention.

Figures 1, 5:
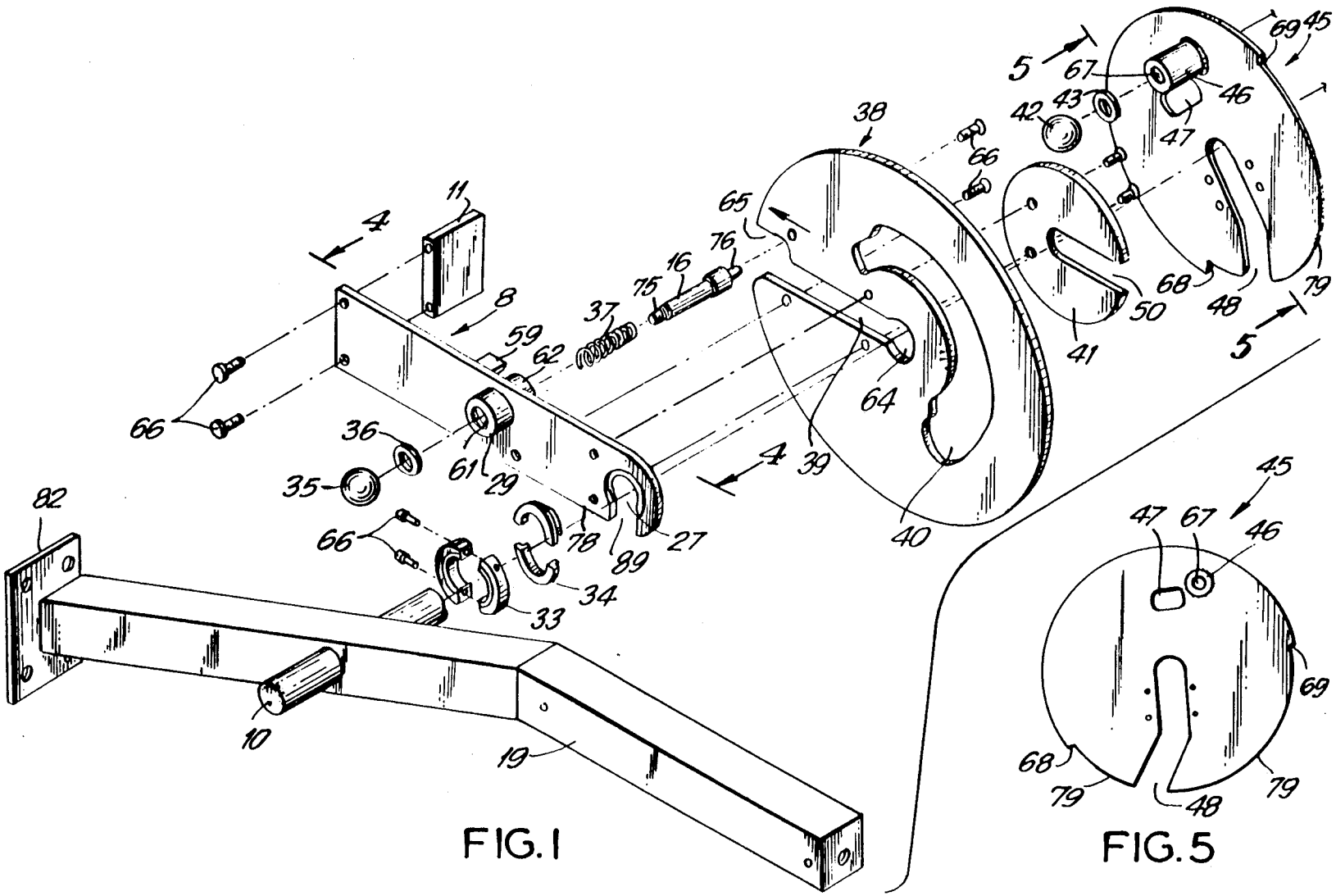
FIG. 1 is an exploded view of portions of a range-limiter device of the present invention for use on a variable-resistance weight machine.
FIG. 5 is an elevated view in isolation of an inside plate of the device along lines 5—5 of FIG. 1.
Figure 1B:
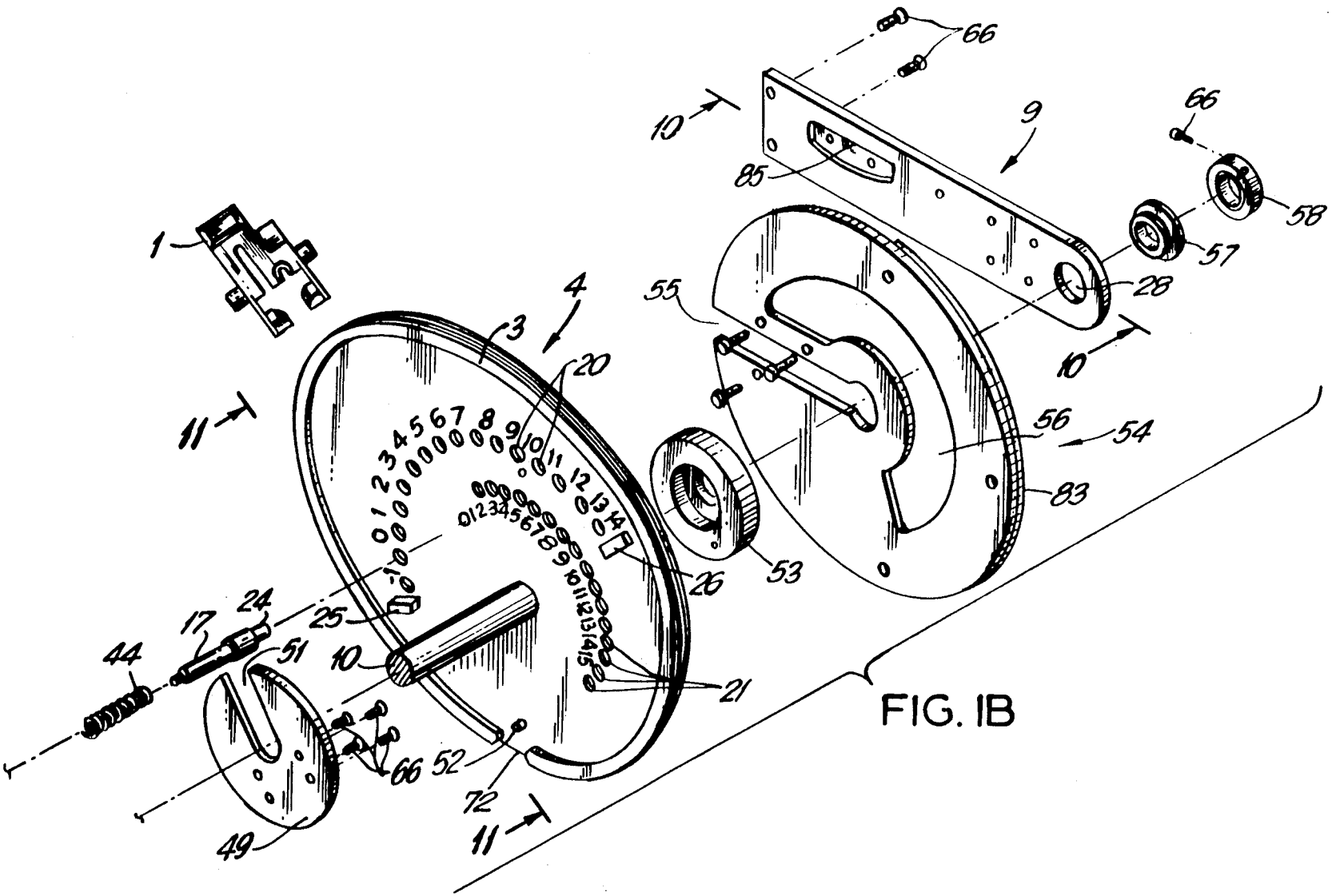
FIG. 1B is a continuation of the exploded view of FIG. 1.

FIGS. 1 and 1B show in exploded views the components of a portion of a range-limiter device. The left-hand side of FIG. 1B is a continuation of the right-hand side of FIG. 1.

A steel input assembly 19, which engages the user's limb during the exercise or rehabilitation protocol, is fixed to a shaft 10. Bracket 82 at one end of input assembly 19 has counterweights attached to it in a conventional fashion. The input assembly 19 may, for example, be part of a leg curl selectorized variable-resistance weight machine 60 shown in FIGS. 13-15.

Steel shaft 10 is fixed to input assembly 19 and rotates with input assembly 19 in response to force exerted by the user on input assembly 19.

Bronze bushing 34, at the far left of FIG. 1, and bushing 57 at the far right of FIG. 1B allow for movement of first and second parallel arms 8 and 9 relative to shaft 10, as described below.

Steel retaining collar 33, adjacent bushing 34 as seen in FIG. 1, serves to hold in place on shaft 10 all components intermediate collar 33 and cam 4, which is fixed to shaft 10. Similarly locking collar 58, adjacent bushing 57 as seen in FIG. 1B, serves to hold in place on shaft 10 all components intermediate cam 4 and collar 58. Locking collar 58 is also used to lock shaft 10 into a standard pillow block mounted on the frame 88 of the machine 60. Shaft 10 is supported on frame 88 by the pillow block and is free to rotate.

A first parallel arm 8, which is substantially rectangular, is rotatably mounted on shaft 10. Bushing 34 allows for relative movement between arm 8 and shaft 10. Arm 8, which is preferably aluminum, is shown in FIGS. 1, 2, 2B, 3 and 4.

At a first end arm 8 has a substantially circular orifice 27 adapted to receive shaft 10. Orifice 27 extends to edge 78 of arm 8 through slot 89. Slot 89 is necessary so that arm 8 can be placed on shaft 10. As seen in FIGS. 1 and 1B all components of the device assembly which are mounted on shaft 10 between the input assembly 19 and a cam 4 must have through-slot 89 or the like because there is no access to one of the ends of the shaft 10 intermediate the input assembly 19 and the cam 4.

Welded through an orifice in arm 8 is a raised cylindrical sleeve 29 having a circular orifice 61 for receipt of a first pull pin 16, as described below. A second side of arm 8, shown in FIG. 4, has a continuation of raised cylindrical sleeve 29. This continuation of sleeve 29, designated as element 62, is of a lesser outside diameter than the outside diameter of sleeve 29. A circular orifice 63 in sleeve 62 communicates with orifice 61 in sleeve 29, thereby providing a passage through arm 8 for receipt of the first pull pin 16. The outside diameter of sleeve 62 is made smaller so that sleeve 62 does not contact the outer diameter of a plate 45 when that plate is rotating.

On the second side of arm 8 is a welded metal tab 59 which serves as a pointer to identify the start position chosen by the user for the range of motion.

Figure 4:
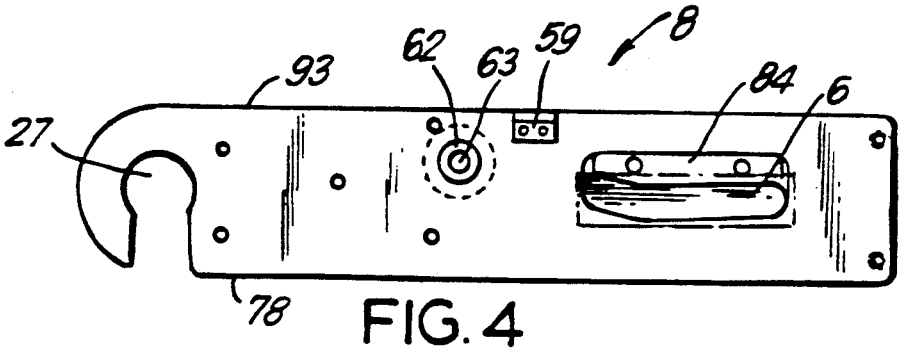
FIG. 4 is an elevated view in isolation of a first parallel arm of the device along lines 4—4 of FIG. 1.
Figure 6:
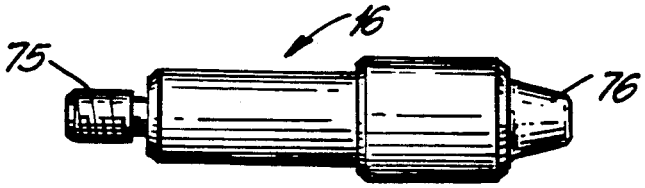
FIG. 6 is an elevated view in isolation of a first pull pin of the device shown in FIG. 1.

The second side of arm 8, shown in FIG. 4, has an interior slot 6 designed to capture a cam-follower feature 5 of a cam follower 1 in a manner described below. A second parallel arm 9, seen in FIGS. 1B and 10, has an interior slot 7 which is a mirror image of the slot 6 in arm 8.

Slots 6 and 7 are machined into the aluminum of arms 8 and 9. Riveted into slots 6 and 7 are contoured steel inserts 84 and 85, respectively. Inserts 84 and 85 support load which aluminum arms 8 and 9 could not take when the arms 8 and 9 are connected to the input assembly 19 and cam 4 and the weight stack 30 is being lifted. Inserts 84 and 85 are mirror images of one another in configuration.

Arms 8 and 9 could be made completely of steel, thus avoiding the necessity of steel inserts 84 and 85. However, steel arms are very heavy and a significant amount of counterweight would be necessary to balance the weight of arms 8 and 9.

A metal block 11 is secured by screws 66 or the like at a right angle to a second end of the arm 8. Block 11 is also secured to arm 9 and serves to connect parallel arms 8 and 9 together and keep arms 8 and 9 in parallel relation.

Moving from left to right in FIG. 1, first arm 8 is followed by a first metal cover plate 38, which is substantially circular in shape. Plate 38 has a central circular orifice 64 for receipt of shaft 10. Extending from orifice 64 through to an edge of the plate 38 is a slot 39 having a notch 65 to provide clearance for the sleeve 62. Slot 39 allows plate 38 to be slid over and rotatably mounted on to shaft 10.

An arcuate slot 40 having a radius less than the plate 38 extends through the plate 38 for the full radius of desired adjustment of the end position for the range of motion. This desired radius varies from machine to machine, depending on the exercise or rehabilitation protocol (leg curl, arm curl, shoulder press, etc.). The arcuate slot 40 provides clearance for a cylinder 46 welded in plate 45 which receives a second pull pin 17. The second pull pin 17 is used to set the stop or end position for the range of motion on the range-limiter device.

Plate 38 is secured to arm 8 by screws 66 or the like.

Following plate 38 is an outer spacer 41 made of plastic or the like. Spacer 41 is circular in configuration and has a radial slot 50 with a semicircular center portion for receipt of shaft 10.

Spacer 41 is secured to plate 38 and arm 8 by screws 66 or the like.

Plastic spacers 41, 49 and 53 act as bearing surfaces which allow the metal components adjacent to the spacers to rotate relative to one another. Spacers 41, 49 and 53 also provide proper space between various components and also insure that arms 8 and 9 are symmetric about cam 4.

Use of spacers 41, 49 and 53 to provide symmetry about cam 4 eases design of the various components for the device and improves the aesthetic appearance.

Following spacer 41 is the inside metal plate 45, shown in isolation in FIG. 5. Plate 45 has a cylinder with a raised cylindrical sleeve 46 welded thereto having a circular orifice 67 for receipt of the second pull pin 17. Adjacent to the sleeve 46 is an opening 47 which serves as a window so the user can view a scale near holes 21 on cam 4. That scale indicates the stop position of the range-limiter device. Plate 45 has a radial slot 48 with a semicircular center portion for receipt of shaft 10. Plate 45 is rotatably mounted on shaft 10.

A portion 79 of the circumference of plate 45 is less in radius than the radius of the remaining circumference of plate 45. This lesser-radial portion 79 extends from lip 68 to lip 69 as shown in FIGS. 1 and 5. Lips 68 and 69 serve to define the limits of the range in which the stop position of the device may be set, as described below.

The exploded view of the cam assembly portion of the range-limiter-device continues in FIG. 1B.

Following plate 45 is an inner spacer 49 made of plastic or the like. Spacer 49 is circular in configuration and has a radial slot 51 with a semicircular center portion for receipt of shaft 10. Spacer 49 serves as a bearing surface to allow for relative rotation between metal plate 45 and metal cam 4.

Spacer 49 is secured to plate 45 by screws 66 or the like.

Following spacer 49 is metal cam 4, which has a varying cam profile in order to vary the mechanical advantage of the weight stack 30 from machine 60 when the user is performing the exercise or rehabilitation protocol on the machine. Cam 4 is shown in isolation in FIG. 11.

Figure 13:
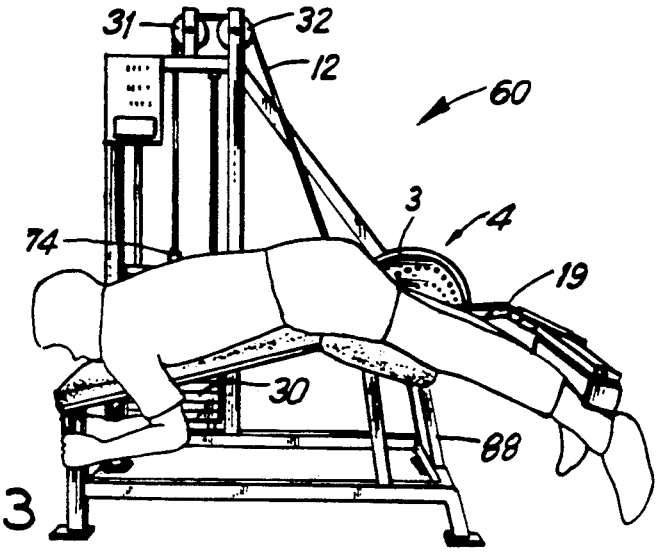
FIG. 13 is a view of a leg-curl selectorized variable-resistance weight machine wherein an input assembly fixed to the cam is in a first start position for the range of motion.
Figure 15:
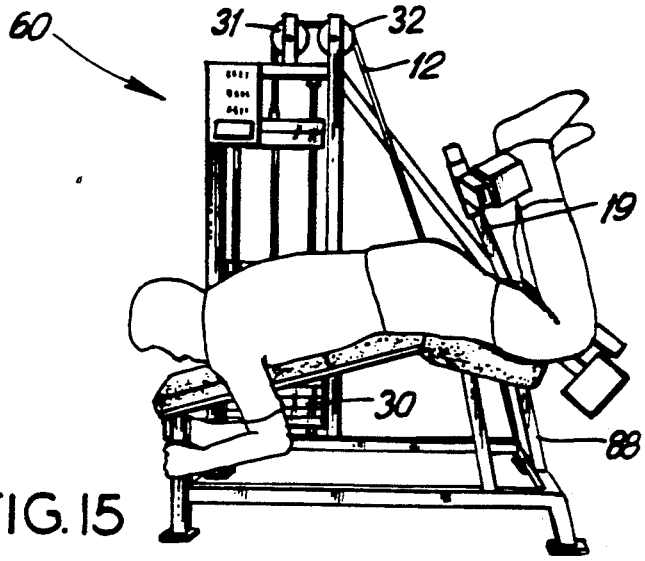
FIG. 15 is a view of the machine of FIG. 13 wherein the input assembly is at a stop position for the range of motion.

The shape of cams such as cam 4 attempt to match the change in anatomical mechanical advantage at each point in the range of motion, for example, the anatomical mechanical advantage at the points between the start position shown in FIG. 13 and the end position shown in FIG. 15. The cam profile of cam 4 depends upon the type of exercise or rehabilitation protocol contemplated (e.g., leg curl, arm curl, shoulder press, etc.) The manner in which the cam profile of cam 4 is designed is well known to those skilled in the art.

As explained above in the Background of the Invention section, the varying radius of the cam profile is an attempt to approximate an ideal situation where the user is lifting as much weight as he or she can at each point in the user's range of motion.

Shaft 10 is welded to and passes through cam 4. Therefore, the input assembly 19 and the cam 4 always rotate together.

Cam 4 has two sets of holes, inner holes 21 and outer holes 20. Outer holes 20 are used to set the start position for the range of motion of the device. Inner holes 21 are used to set the stop position for the device. The hole locations are equally spaced in each instance in the present embodiment, and marker designations such as the numbers "−1" through "14" (outer holes 20) and "0" through "15" (inner holes 21) are used to identify the start and stop locations.

The hole locations "0" for each of set of holes 20 and 21 represent the approximate anatomical zero point (as that term is understood by therapists and clinicians) for various exercise and rehabilitation protocols. For example, anatomical zero for a leg-curl protocol is the straight-out leg position shown in FIG. 13. Use of the "0" designation allows the therapist or clinician to quickly set the input assembly 19 of the machine to the anatomical zero position.

The advantage of equally spaced hole-location increments for the present embodiment is that the clinician or therapist can easily calculate what the set range of motion is by substracting the number visible in window 46 from the number aligned with tab 59, and multiplying the result by ten. In the present embodiment, holes 20 and 21 are separated from one another by 10°. For example, if the number visible in window 46 is "8" and tab 59 is aligned with the number "3", the set range of motion is 50°.

Holes 20 and 21 need not be equally spaced, though it is preferred to have them so for the reasons outlined above.

Pull pin 16 engages in holes 20 to determine the start position for the range of motion for the range-limiter device and pull pin 17 engages in holes 21 to determine the stop position for the range of motion for the range-limiter device, as discussed below. Tab 59 on arm 8 points to the start position number 20. The end position number 21 may be viewed through window 46 in plate 45.

Figure 3:
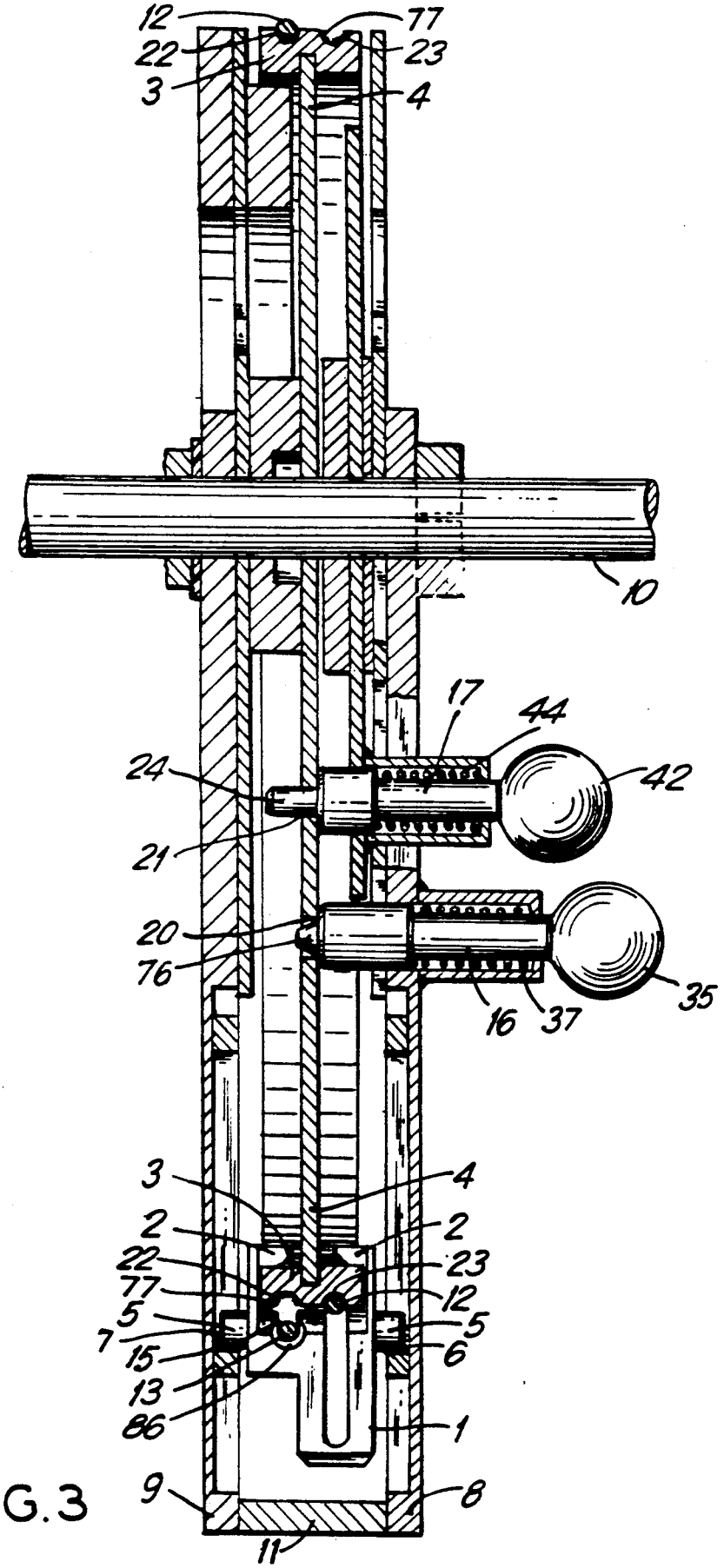
FIG. 3 is an enlarged edge view in elevation along lines A—A of FIG. 2B.
Figure 11:
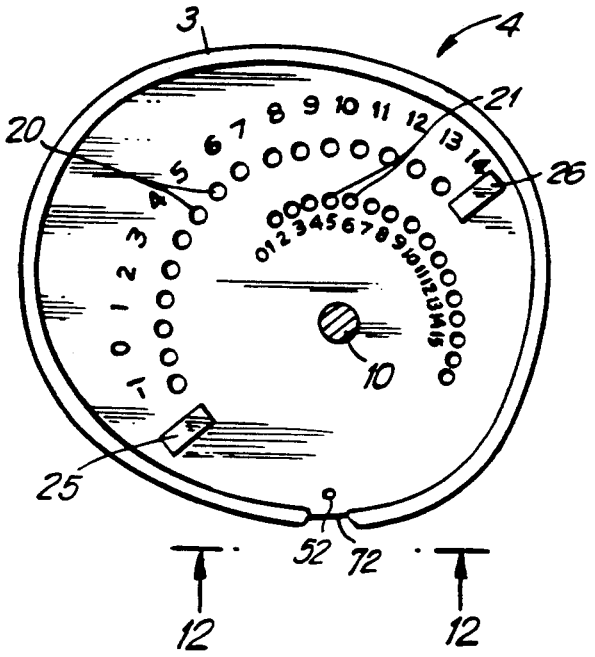
FIG. 11 is an elevational view in isolation of a cam and attached cam track along lines 11—11 of FIG. 1B.
Figure 12:
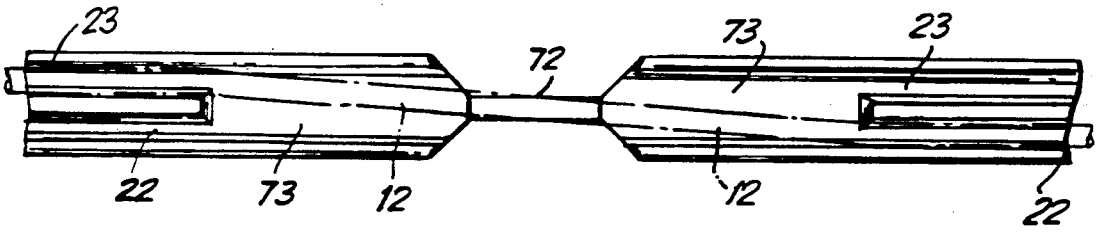
FIG. 12 is an enlarged edge view of the cam and attached cam track of FIG. 11 along lines 12—12 of FIG. 11, wherein a portion of the cable is shown in grooves on the cam track.

The outer perimeter of the cam 4 has fixed to it a cam track 3, best seen in FIGS. 1B, 3 and 12. Cam track 3 extends around the entire perimeter of cam 4 except at a small portion 72, as seen in FIG. 12. Portion 72 has to be long enough to allow cam follower 1 to be slid over one of the ends of cam track 3. The cam track 3 has a first cam track groove 22 and a second cam track groove 23 extending along its entire perimeter, except for a small portion 73 at each end of the cam track 3, as seen in FIGS. 11 and 12.

Grooves 22 and 23 receive the cable 12 in the manner described below.

Cylindrical protrusion 52 welded to cam 4 serves to prevent the user from exceeding the stop position range "0–15". When assembled, the lesser radial portion 79 of plate 45 does not come into contact with the protrusion 52 because that protrusion is outside the radius of lesser radial portion 79. However, when plate 45 is rotated to the limits of the "0–15" range, lip 68 or lip 69 on plate 45 abuts cylindrical protrusion 52 on cam 4. This prevents further rotation of plate 45.

Polyhedron protrusion 25 welded to cam 4 prevents the user from trying to adjust the start position for the range of motion in a counter-clockwise direction past the hole 20 designated as "−1". A similar polyhedron protrusion 26 on cam 4 prevents adjustment of the start position for the range of motion in a clockwise direction past the hole 20 designated as "14". In these situations, sleeve 62 on arm 8 hits against the appropriate protrusion, either 25 or 26. This stops pin 16 from moving past the "−1" or "14" positions.

Behind cam 4 is a cylindrical plastic spacer 53 with a central orifice for shaft 10. Spacer 53 serves as a bearing surface between metal cam 4 and a second metal cover plate 54. Spacer 53 is thicker than the spacer 41 and 49 in order to provide symmetry around cam 4, since there are fewer components to the right of cam 4 than to the left, as viewed from FIGS. 1 and 1B.

Next is a second cover plate 54 substantially circular in configuration. Plate 54 has an arcuate slot 56 which receives an end 24 of the second pull pin 17.

Figure 15A:
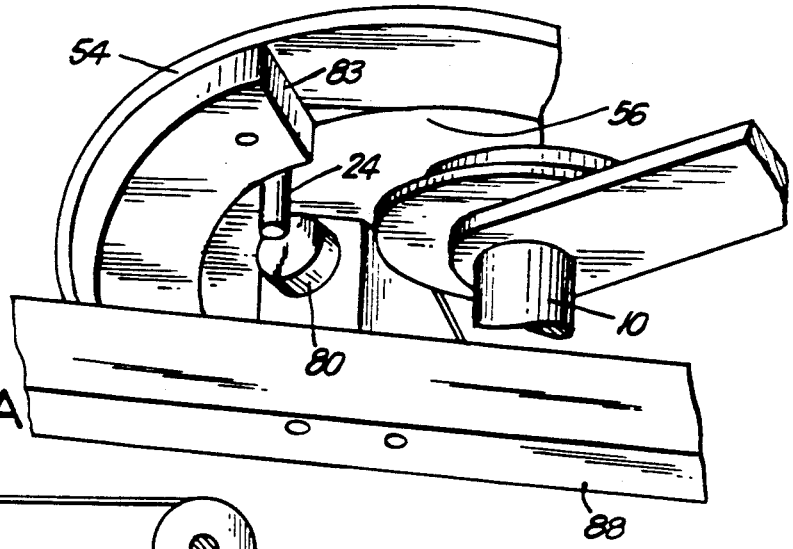
FIG. 15A is a partial perspective view showing a portion of the range-limiter device and a first fixed stop on a frame of the machine wherein the position of the first fixed stop relative to the second pull pin represents the end point in the range of motion of the input assembly.

Slot 56 also receives a first fixed stop 80 attached to the frame 88 of the machine 60, as shown in FIG. 15A.

As seen in FIG. 15A, first fixed stop 80 on frame 88 extends into slot 56. At some point in the range of motion, depending on which of the holes 21 the pin 17 is inserted into, end 24 of pin 17 will hit first fixed stop 80 and will stop further rotation of the input assembly 19. This occurs because pin 17 rotates with cam 4 and cam 4 will stop rotating when pin 17 comes in contact with stop 80.

Figure 8:
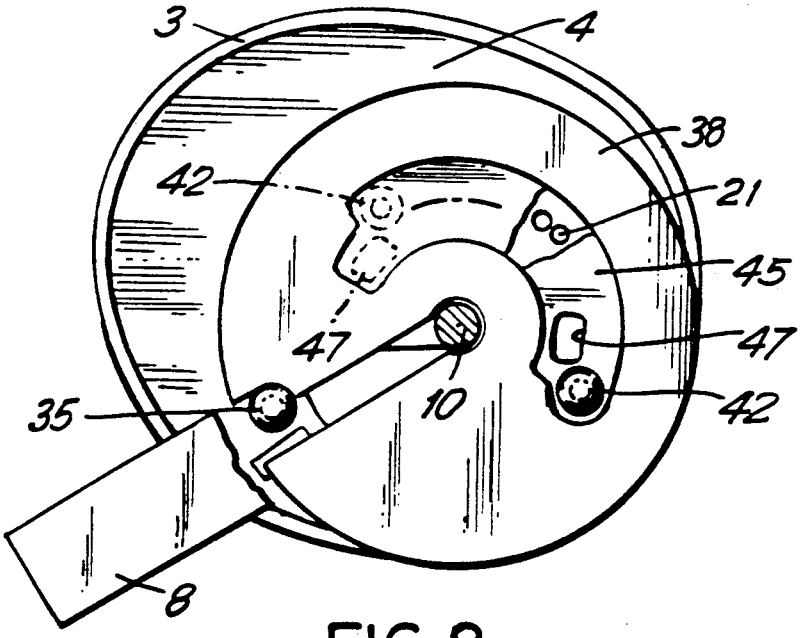
FIG. 8 is an elevated view, partly in section, of a portion of the device wherein adjustment of the stop position for the range of motion is shown in dotted line, and rotation of an inside plate is in the direction of the arrow shown in the figure.
Figure 7:
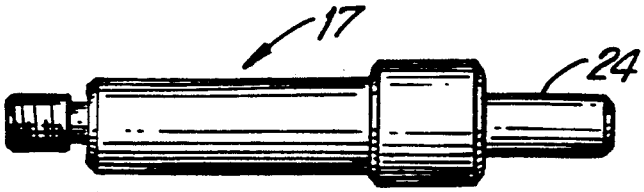
FIG. 7 is an elevated view in isolation of a second pull pin of the device shown in FIG. 1B.
Figure 10:
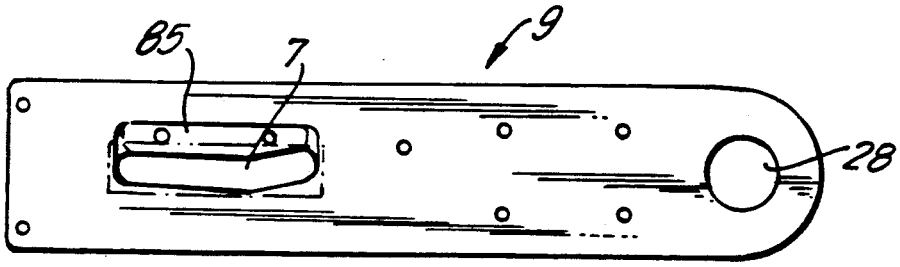
FIG. 10 is an elevational view in isolation of a second parallel arm along lines 10—10 of FIG. 1B.

FIG. 8 shows in dotted line rotation of plate 45 and knob 42 for the adjustment of the stop position for the range of motion, wherein plate 45 and knob 42 (with attached pin 17) are rotated in the direction of the arrow.

The presence of slot 56 allows the first stop 80 on frame 88 to be placed in close proximity to cam 4. This arrangement avoids having end 24 of pin 17 cantilevered out too far from the cam 4. End 24 would be subject to bending or breakage if it were a further distance from cam 4.

Plates 38 and 54 are secured to the range-limiter device in such a fashion that arcuate slots 40 and 56 line up with one another.

The back side of plate 54 has a counterbalance weight 83 which counterbalances the weight of arms 8 and 9, block 11 and all other components which are fixed to arms 8 and 9. Because arms 8 and 9 are made of aluminum, except for the small steel inserts 84 and 85, counterbalance weight 83 need not be very heavy. If arms 8 and 9 were made of steel, a greater counterbalance weight than weight 83 would be necessary to counterbalance the weight of arms 8 and 9.

Following plate 54 is the second aluminum parallel arm 9. Arm 9 is rectangular except at a first end which terminates in a semi-circular fashion. The first end of arm 9 has a circular orifice 28 for receipt of shaft 10. On one side of arm 9, facing arm 8, is a slot 7 which is the mirror image of slot 6 in arm 8. A second end of arm 9 is secured to block 11.

Slot 7 on arm 9 has contoured steel insert 85 riveted thereto to support load in the manner described below.

As shown in FIG. 3, arms 8 and 9 are in parallel relation when the device is assembled.

Plate 54 is secured to arm 9 by screws 66 or the like.

After passing through circular orifice 28 in arm 9, shaft 10 protrudes through bushing 57 and through locking collar 58. Locking collar 58 is captured by a conventional pillow block (not shown) mounted on frame 88 of machine 60.

It is seen in FIGS. 1 and 1B that slots 89 (arm 8), 39 (plate 38), 50 (spacer 41), 48 (plate 45), and 51 (spacer 49) are not colinear with one another so that shaft 10 is properly captured by all components intermediate input assembly 19 and cam 4.

More details concerning pull pins 16 and 17 will now be given. The assembly for pull pin 16 consists of a knob 35, a washer 36, and a compression spring 37. The pin 16 has a first end 75 and a second end 76. Compression spring 37 is placed around the portion of pin 16 intermediate ends 75 and 76. Knob 35 and washer 36 are assembled over end 75 as shown in FIG. 1. When assembled, first end 75 extends through orifices 63 and 61 in sleeves 62 and 29, respectively.

In operation, spring 37 always biases pin 16 in such a manner that end 76 is engaged in one of the outer holes 20 in cam 4. In order to disengage end 76 from one of the holes 20, it is necessary for the user to grasp knob 35 and apply a force to overcome the biasing force of spring 37.

Since pull pin 16 is mechanically connected to parallel arms 8 and 9, engaging end 76 of pin 16 in one of holes 20 results in the parallel arms 8 and 9 being mechanically connected to cam 4, shaft 10 and input assembly 19.

Pull pin 17, knob 42, washer 43 and compression spring 44 are assembled in the same manner as pull pin 16 and its related components. Pin 17 is mechanically attached to plate 45 through orifice 67, as shown in FIGS. 1 and 1B. The end 24 of pull pin 17 engages in one of the inner holes 21 on cam 4. To disengage pin 17, the user must grasp knob 42 and apply a sufficient force to overcome the biasing force of spring 44.

It is readily seen from the description above that the input assembly 19, the shaft 10 and the cam 4 are all fixed to one another and rotate together at all times. Parallel arms 8 and 9 are fixed to the combination of assembly 19, shaft 10 and cam 4 only when pull pin 16 is engaged in one of the outer holes 20 on cam 4.

The arms 8 and 9 and cam follower 1 and associated components may be viewed as a cable supporting means for supporting end 13 of cable 12.

Reference is now made to FIGS. 3, 9, 9A and 9B where the cam follower 1 is shown.

Figure 9A:
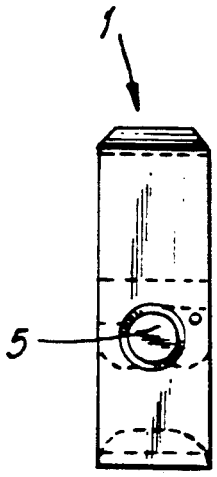
FIG. 9A is an end elevational view of the cam follower along lines A—A of FIG. 9.
Figure 9:
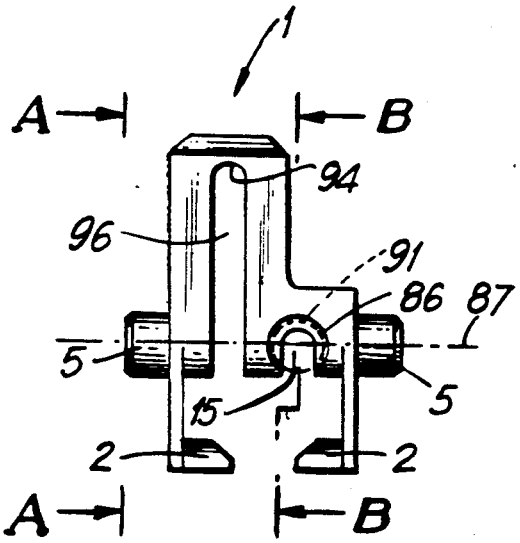
FIG. 9 is a front elevational view in isolation of a cam follower of the device.
Figure 9B:
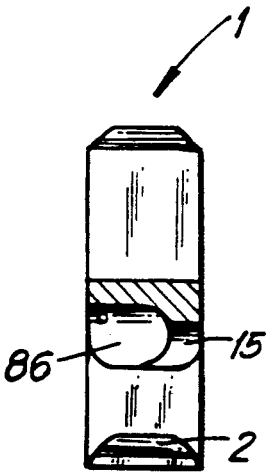
FIG. 9B is an elevational section view of the cam follower along lines B—B of FIG. 9.

Cam follower 1, shown in isolation in FIGS. 9, 9A and 9B, terminates at its lower end in two L-shaped sections 2. As best seen in FIG. 3, L-shaped sections 2 surround the cam track 3. Extending outwardly from either side of cam follower 1 are cylindrical cam-follower features 5, which are captured in slots 6 and 7 in plates 8 and 9 and ride in those slots in the manner described below.

Cam follower 1 has a first hole 15 vertically aligned with cam track slot 22 which receives a second end 13 of the cable 12. Partially surrounding hole 15 is a countersink 86. Attached to the second end 13 of the cable 12 is an oversized end fitting 91, shown in dotted line in FIG. 9. End fitting 91 has a diameter greater than the diameter of hole 15, but less than the diameter of countersink 86. This insures that the end 13 of the cable 12 remains in the hole 15 of the cam follower 1.

A longitudinal slot 96 is provided in cam follower 1 so that cable 12 can ride in slot 96 as the cam 4 rotates relative to arms 8 and 9. As the cam 4 rotates relative to the arms, the changing radius of the cam 4 causes the cable 12 to ride up and down in slot 96. Slot 96 is long enough to accommodate any change in angle between the cable 12 tangent point to the cam 4 and the tangent point at pulley 32 for a wide-range of cam profiles.

Figure 2:
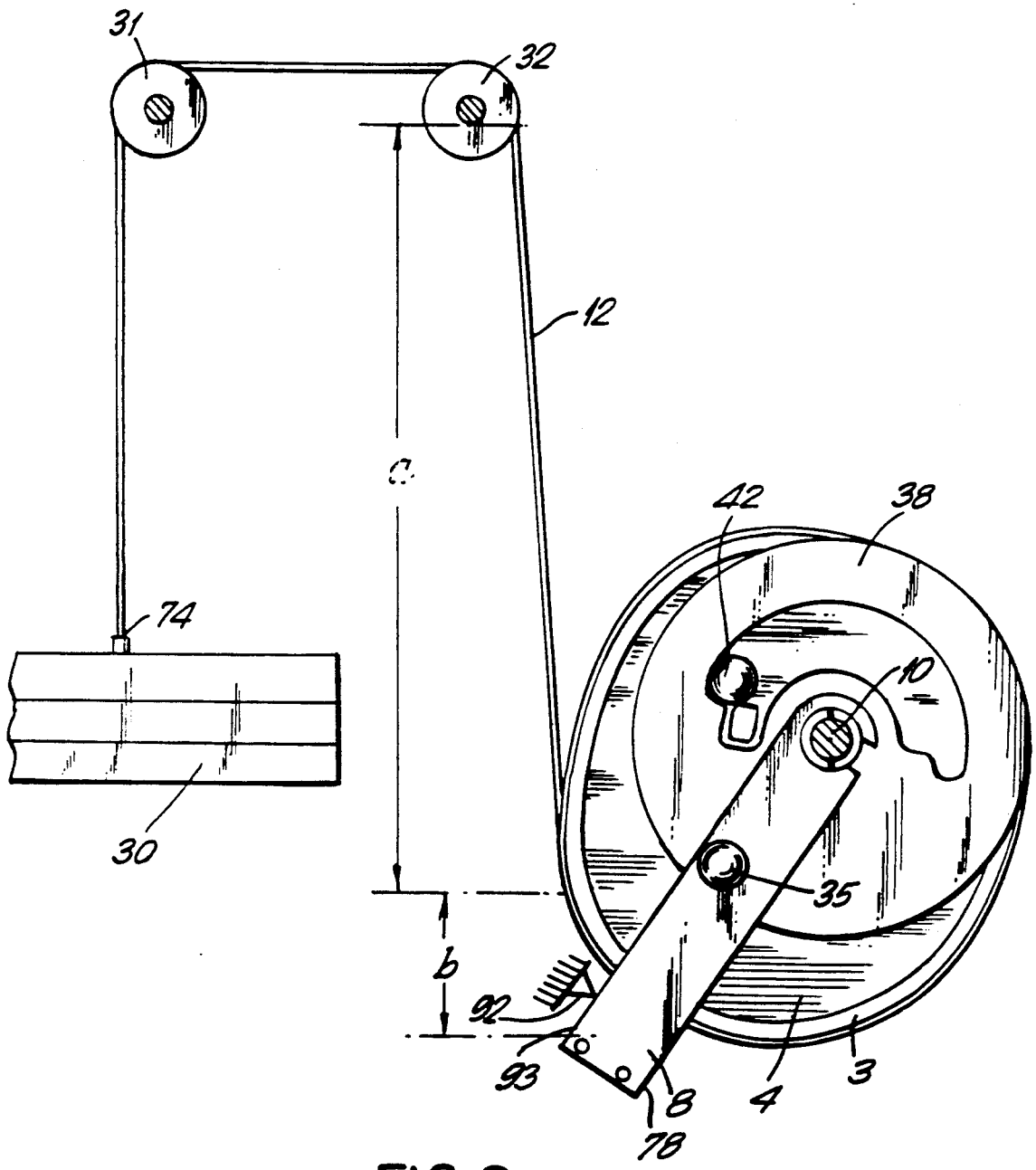
FIG. 2 is an elevated view of the range-limiter device connected to a weight stack of a weight machine through a cable, wherein the device is in a first start position for the range of motion.

A first end 74 of the cable 12 terminates in the weight stack 30 on the machine 60, as seen in FIGS. 2 and 15.

An intermediate portion of the cable 12 between ends 13 and 74 wraps around the cam in slot 22 on cam track 3 until the cable 12 reaches portion 72 on cam 4, at which point the cable 12 crosses over to slot 23, and then continues to wrap around the cam 4 in slot 23. This crossover from track 22 to 23 is shown in FIG. 12.

Figure 2B:
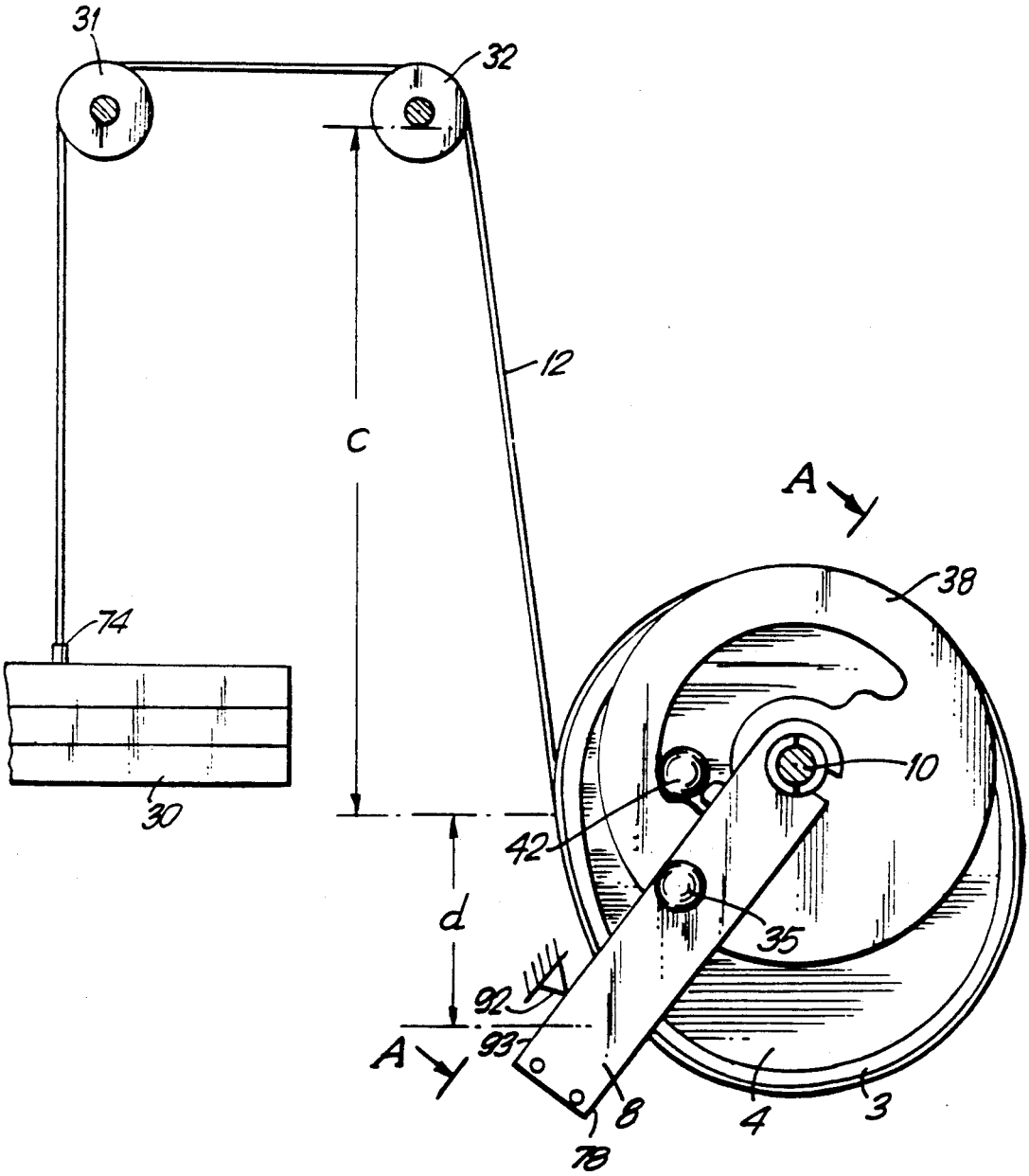
FIG. 2B is a view of the weight stack and the device of FIG. 2 wherein the device is in a second start position for the range of motion.

The cable 12 then tangentially leaves cam 4 and travels to pulley 32, as seen in FIGS. 2 and 2B. From pulley 32 the cable 12 goes to pulley 31 and then to weight stack 30 at cable end 74.

It is seen that cable 12 is wrapped around the entire circumference of cam 4, with all of the advantages thereto, as described below.

So long as end 76 of pin 16 is engaged in one of the holes 20 in cam 4, parallel arms 8 and 9 are mechanically connected to input assembly 19, shaft 10 and cam 4. Since the cam follower 1 captured in slots 6 and 7 of arms 8 and 9 carries end 13 of cable 12, mechanical connection of arms 8 and 9 to cam 4 results in the cable 12 being connected to the cam. The weight stack 30 moves as the user rotates the input assembly 19.

In other words, when pull pin 16 is engaged in holes 20 in the cam 4, the device of the present invention acts as any other variable-resistance weight machine, such as the EAGLE® line of weight machines, where the cable is wound up on the cam, thereby lifting the weight stack, as the input assembly 19 is rotated by the user.

End 76 of pin 16 is tapered to make it easier to engage and disengage pin 16 in one of the holes 20.

Figure 14:
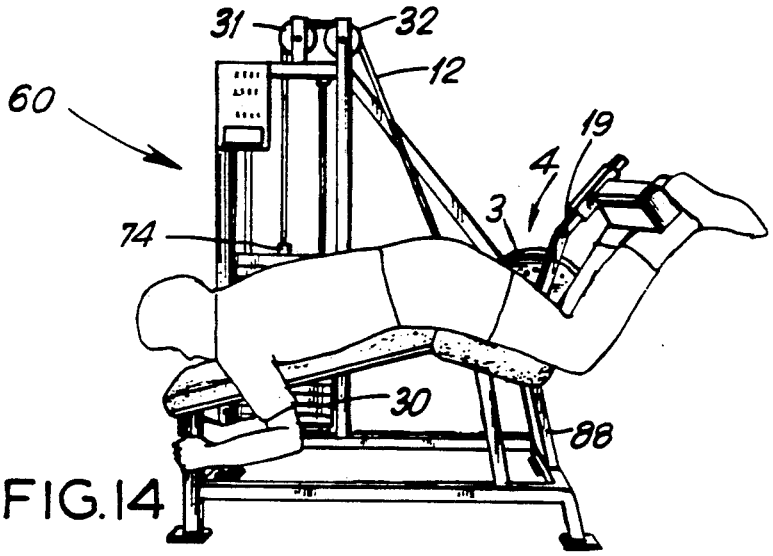
FIG. 14 is a view of the machine of FIG. 13 wherein the input assembly is in a second start position for the range of motion.

All similarity to known prior art variable-resistance weight machines ends at such time as the user changes the start position for the range of motion using the present device, for example from the start position shown in FIG. 13 to the start position shown in FIG. 14.

To accomplish this change of start position, the user pulls knob 35 and overcomes the biasing of spring 37. This disengages end 75 of pin 16 from one of the holes 20, and thereby mechanically disconnects the parallel arms 8 and 9 from the cam 4. This results in the cable 12 being disconnected from the cam 4 because the cam follower 1, which is captured in slots 6 and 7 of arms 8 and 9, retains the cable in hole 15.

The user then rotates the input assembly 19 to the desired starting position of the range of motion, for example to the start position shown in FIG. 14. The input assembly 19 and the cam 4 move together since they are both fixed to shaft 10. However, the arms 8 and 9 remain stationary, as shown in FIGS. 2 and 2B, while this starting point adjustment is made. So long as the arms 8 and 9 do not rotate, the weight stack 30 will not be lifted by cable 12. This permits the user to adjust the start position for the machine without having to lift any of the weights on the weight stack 30, a marked advantage over some of the prior art adjustment mechanisms for selectorized variable-resistance weight machines.

Because the cam 4 and the cable 12 are no longer connected to one another during the start-position adjustment, the cable 12 slides over the surface of cam track 3. An anti-friction coating 77 is applied to grooves 22 and 23 on cam track 3 to aid in overcoming any drag due to the sliding of cable 12 in those grooves.

Also, since the cam 4 rotates with the input assembly 19 as the start-position adjustment is made, the rotational orientation of the input assembly 19 relative to the profile of the cam 4 does not change. This latter aspect is critical to insure that the change in the anatomical mechanical advantage of the user is matched appropriately by a change in the cam profile at each point in the range of motion, and represents a significant development over start-position adjustments in many of the known prior art variable-resistance weight machines.

Once the user rotates the input assembly 19 to the desired start position, the user then releases knob 35 and engages end 76 of pin 16 in the appropriate hole 20. Once engaged in a hole 20, the device acts as a conventional variable-resistance weight machine.

In summary the range-limiter device shown in FIGS. 1-12 and described above allows for fast and easy adjustment of the start position for the range of motion without (1) requiring the user to lift the weight stack to make the adjustment; (2) changing the orientation of the cam mechanical advantage in relation to the anatomical mechanical advantage; and (3) the necessity of repositioning a mechanical stop against which the input assembly 19 must rest at every start position in the range of motion.

Reference is now made to FIG. 2 which depicts the weight stack 30, pulleys 31 and 32, cable 12, a portion of the range-limiter device and a second fixed stop 92. It is understood that element 12 may be any suitable cable means, such as an actual wire cable, a chain, a belt or the like.

The cable 12 at end 74 connects to the top weight plate on the weight stack 30, extends over pulleys 31 and 32, contacts the cam 4 of the range limiter-device, wraps completely around the cam 4 and terminates in the cam follower 1.

Second fixed stop 92 is on frame 88 of the machine 60 and acts to prevent any motion of the arms 8 and 9 due to inertial effects of the system. At all start positions in the range of motion arms 8 and 9 rest against stop 92. When arms 8 and 9 are connected to cam 4 by means of pull pin 16, the arms 8 and 9 rotate in response to rotation of the input assembly 19 by the user in the direction away from stop 92. The user can never rotate the input assembly 19 past the position of stop 92.

An example of an inertial effect which may cause arms 8 and 9 to try to rotate against stop 92 includes the effect due to the weight plates of the weight stack 30 slamming down when the user quickly releases the input assembly 19. If the arms 8 and 9 rotated past the stop 92 in response to the inertia developed in such a situation, then the cable 12 could go slack and could fall off of the pulley 32.

Referring to FIGS. 2 and 2B, the total length of the cable 12 is fixed, as is the distance, in the resting state, from the top weight to the first pulley 31 and from the first pulley 31 to the second pulley 32.

As can be seen when comparing FIGS. 2 and 2B, the distance or length of cable between the tangent point on pulley 32 and the tangent point on the cam track 3, designated as "a" and "c" in those figures and known as the cable free length, changes when the input assembly 19 is rotated to a new start position using the range-limiter device. This change in the cable free length is due to the shape of cam 4 and the fact that the changing cam profile relocates the point of tangency of the cable 12 to the cam 4. Since the distance from weight 30 to pulley 32 is constant, the change in free length has to be equal and opposite to the change in the length of cable 12 in contact with the cam 4 in order for the total length to remain a constant.

The change of the length of cable 12 in contact with the cam 4 is accomplished using two mechanisms. The first is a change in overlap. Overlap is defined as that portion of the cam track 3 which has cable 12 in both grooves 22 or 23. These sections of cam track 3 containing overlap are designated as segments "b" and "d" on FIGS. 2 and 2B, respectively. Another way to define overlap is to look at the distance between the cable termination 13 in the cam follower 1 and the point at which the cable 12 and cam track 3 are tangent.

As cam 4 in FIG. 2B is rotated clockwise to the position in FIG. 2, the free length of cable 12 increases as seen by comparing the lengths designated as "c" and "a". In doing so, less of cable 12 comes into contact with cam track 3, decreasing the overlap. Because of the irregular profile of cam 4, the decrease in overlap will not equal the increase in free length, creating slack in cable 12 in this particular example.

It can be seen that different profiles or different geometries could also create a tension in the cable. Neither slack nor tension is acceptable since in the former case the cable slack will allow free rotation of the input assembly 19 without lifting the weight stack 30. Also, the cable 12 could fall off the pulley 32. Any tension created in the cable 12 would tend to lift the weight stack 30, thereby inhibiting any further adjustment of the start position.

A second mechanism is required to compensate for the difference between the change in overlap and the change in free length. That mechanism consists of the cam follower 1 and slots 6 and 7 in arms 8 and 9. Since the cam follower 1 captures the cam track 3 (which in turn is rigidly fastened to the cam 4), changes in cam profile will force the cam follower 1 to displace radially. The cam follower 1 motion is further constrained by cam-follower features 5 residing within slots 6 and 7 in arms 8 and 9, slots 6/7 acting to guide cam follower 1 circumferentially, either clockwise or counterclockwise, around the cam 4. Referring to FIG. 2, if slot 6 were so shaped as to position cam follower 1 close to edge 78 on arm 8, there would be more cable 12 in contact with the cam track 3 than if the slot 6 was so shaped so to position the cam follower 1 close to edge 93 on arm 8. In other words, the slot 6 shape is so defined so as to work in synergy with the change in cam radius in order to position the cam follower 1 and increase or decrease the amount of cable 12 in contact with cam track 3, thereby compensating for the differences between the change in free length of cable 12 versus the change in the length of overlap. The shape of slot 7 by definition is the mirror image of the shape of slot 6.

Referencing FIG. 9, it is seen that the cam-follower features 5 and hole 15 in cam follower 1 share a common centerline 87. If the centerline for hole 15 (which retains cable end 13) were different than the centerline for features 5, then an unwanted torque could develop when the cable 12 is pulling on the load of the weight stack 30. If a sufficient torque develops, the cam follower 1 will rotate in a direction into and out of the page in FIG. 9, jamming itself on the cam track 3, and rendering the range-limiter device inoperative.

The slots 6 and 7 in arms 8 and 9 are so designed that any load exerted by cam-follower features 5 is directed against the contoured steel inserts 84 and 85, rather than the aluminum portion of slots 6 and 7. Those inserts 84 and 85 are better able to absorb load than the aluminum which defines slots 6 and 7.

A procedure for empirically deriving the shape of slots 6 and 7 in arms 8 and 9 will now be described.

There are several methods available to determine the required shape of the slot 6/7 in parallel arms 8 and 9. Two such methods include (1) a mathematic modelling of the system and the calculation of each point and (2) the empirical derivation of the slot shape.

Due to the complexity of the computations required in the former method versus the efficiency and accuracy of the latter, the use of empirical data was determined to be the optimal method.

The following is an explanation of the empirical method used in determining the shape of the slot 6/7 in parallel arms 8 and 9. The slot 6/7 derived by the following empirical method satisfies the requirement of properly locating the cam follower 1 thereby minimizing the slack or tension in the cable 12 resulting from adjustment of the start position of the input assembly 19.

A variable-resistance weight machine having a portion of the range-limiter device as shown in FIGS. 1–12 is used to derive the slot configuration. The following steps are taken.

(1) Initially, parallel arms 8 and 9 have a straight slot machined in one surface thereof. These slots are centered and parallel to the centerline of each arm. The length of the slot is determined by the difference between the maximum and minimum radius on the perimeter of cam 4 which will come into contact with the cam follower 1 during the exercise or rehabilitation protocol.

(2) A first test resting position for the parallel arms 8 and 9 is selected based on the following criteria: the parallel arms 8 and 9 are rotated as far as possible in the direction which will minimize cable overlap (as that term has been previously defined) on the cam 4. While maintaining the cable 12 tangent to the cam track 3, the arms 8 and 9 are rotated until the cable 12 rides up through longitudinal slot 96 in cam follower 1 to the top 94 of that slot. Once the position is found, the parallel arms are clamped in place.

(3) The top weight is suspended approximately once inch above the weight stack by shortening the cable 12.

Once the variable-resistance weight machine is set up as outlined above, a precision height gage is attached to the frame so that the change in height of the suspended top weight can be measured as the input assembly 19 is rotated to its various start positions, i.e., the cam 4 is rotated so as to allow the end 76 of pin 16 to engage the various holes 20 in cam 4. The incremental change in height of the top plate is an exact indication of the error between the change in cable free length versus the accompanying change in overlap. In other words the change in height of the weight plate is equal to the change in circumferential position of the cam follower 1 required in order to eliminate tension or slack in cable 12. At each location of the end 76 of pin 16 in a hole 20 of cam 4, the radius of cam 4 at the location of the cam follower 1 is noted along with the deviation of the height of the weight plate. As the change in the height of the weight plate is indicative of the circumferential deviation required of the cam follower 1, the radius is the indicator of the dimension along the length of the slot where that deviation is to occur.

For example, if the data at the hole 20 in cam 4 designated as "3" indicates that the weight plate has been upwardly displaced 0.20 inches from its neutral position and that the cam radius at the cam follower 1 is ten inches, then at a point along the slot 6/7 corresponding to the ten-inch radius, the slot 6/7 must be shaped so as to guide the cam follower 1 a distance of 0.20 inches in such a direction as to allow the weight plate to remain at its neutral position.

From the set of data generated—the required cam follower deviation at a particular radius, for each of the starting positions represented by the various holes 20 in cam 4—a total slot shape is generated. Various test resting positions of the parallel arms 8 and 9 are tried until the generated slot shape collapses into a 'best' curve profile, 'best' being defined as the profile adhering to the following qualifications:

(1) The slot must be a producible shape, one that does not have two different required cam-follower deviations at the same location along the slot;

(2) The maximum required deviations must fall within the width of the parallel arms 8 and 9; and (3) The slot must be smooth and not include any sudden or irregular change in profile which would impede the movement of the cam follower 1 along the slot 6/7.

The device shown in FIGS. 1–12 may be made more simply by eliminating one of the slots 22 or 23 on cam track 3 and shortening the cam track 3 to, for example, a length which fits over approximately 120° of the circumference of the cam 4. In this second embodiment, shown in FIGS. 16, 16A and 17, the end 13 of the cable 12 is fitted into orifice 15' in cam follower 1'. The cam follower 1' is similar to the cam follower 1 in the previous embodiment with orifice 15' in the same centerline as cam-follower features 5'. Cam follower 1' also has a countersink 86' for retention of an end fitting. Cam follower 1' does not have a longitudinal slot such as 96 for cam follower 1 since there is no second groove on cam track 3' for the cable 12.

Cam track 3' has only one groove 22', which is centered over the cam 4. Cam follower 1' rides on cam track 3' and cam follower features 5' are captured in slots 6 and 7 in arms 8 and 9, as in the FIGS. 1–12 device.

Figure 16:
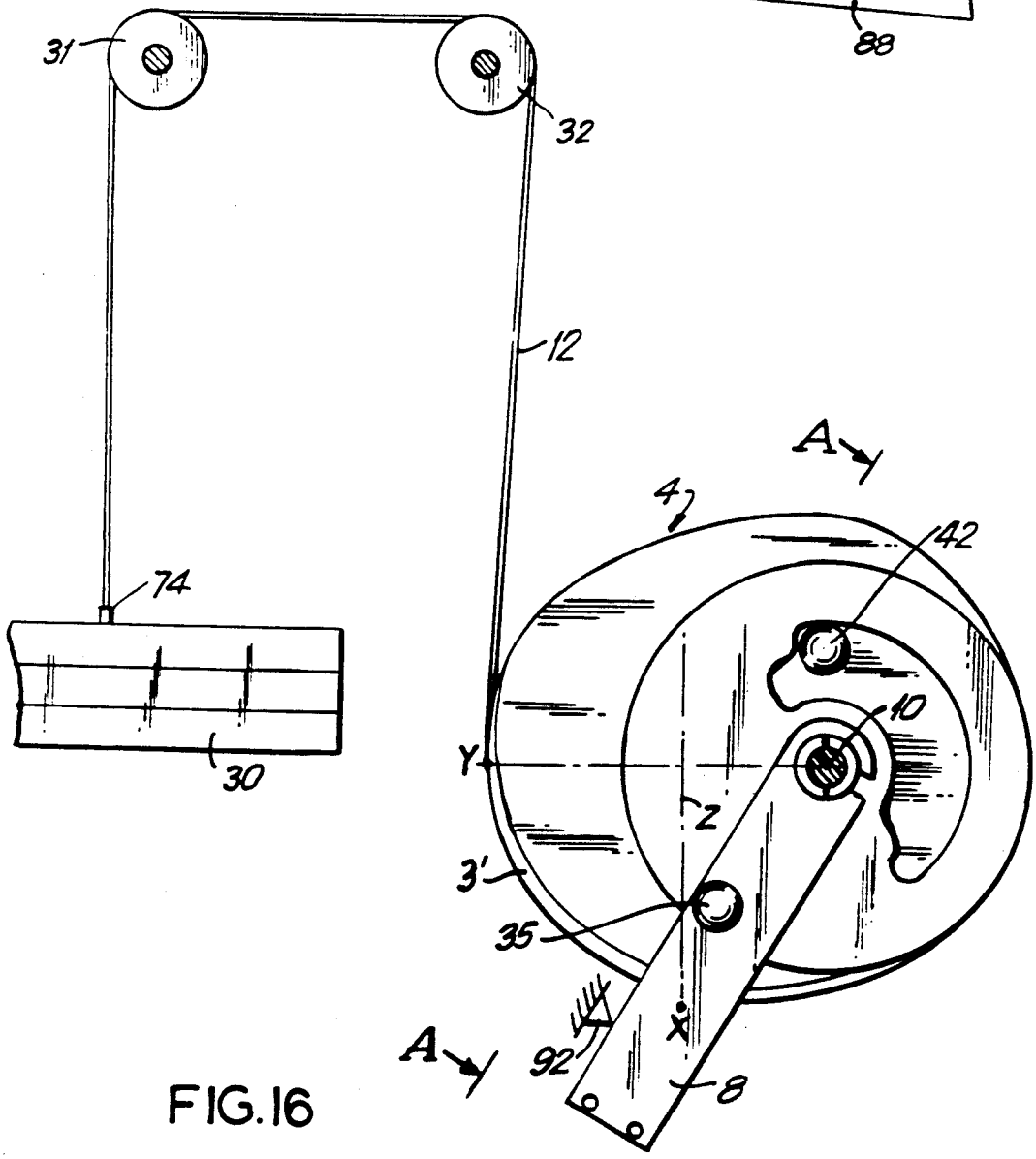
FIG. 16 is an elevated view of a second embodiment of the range-limiter device of the present invention connected to a weight stack of a weight machine through a cable.
Figure 17:
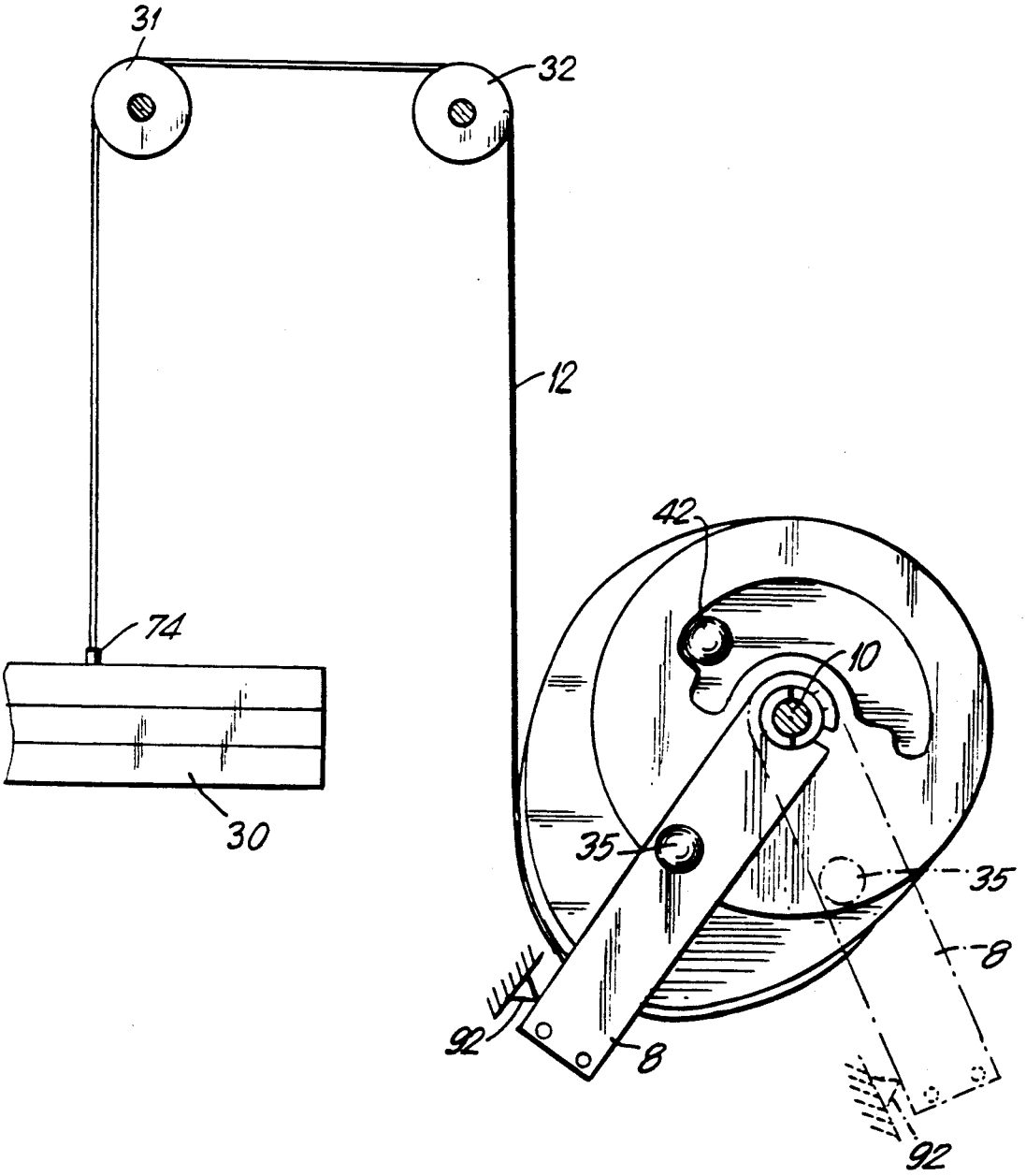
FIG. 17 is an elevated view of the second embodiment similar to the view shown in FIG. 16 wherein a cam shown in FIG. 17 has a more radical profile than the cam shown in FIG. 16.
Figure 18:
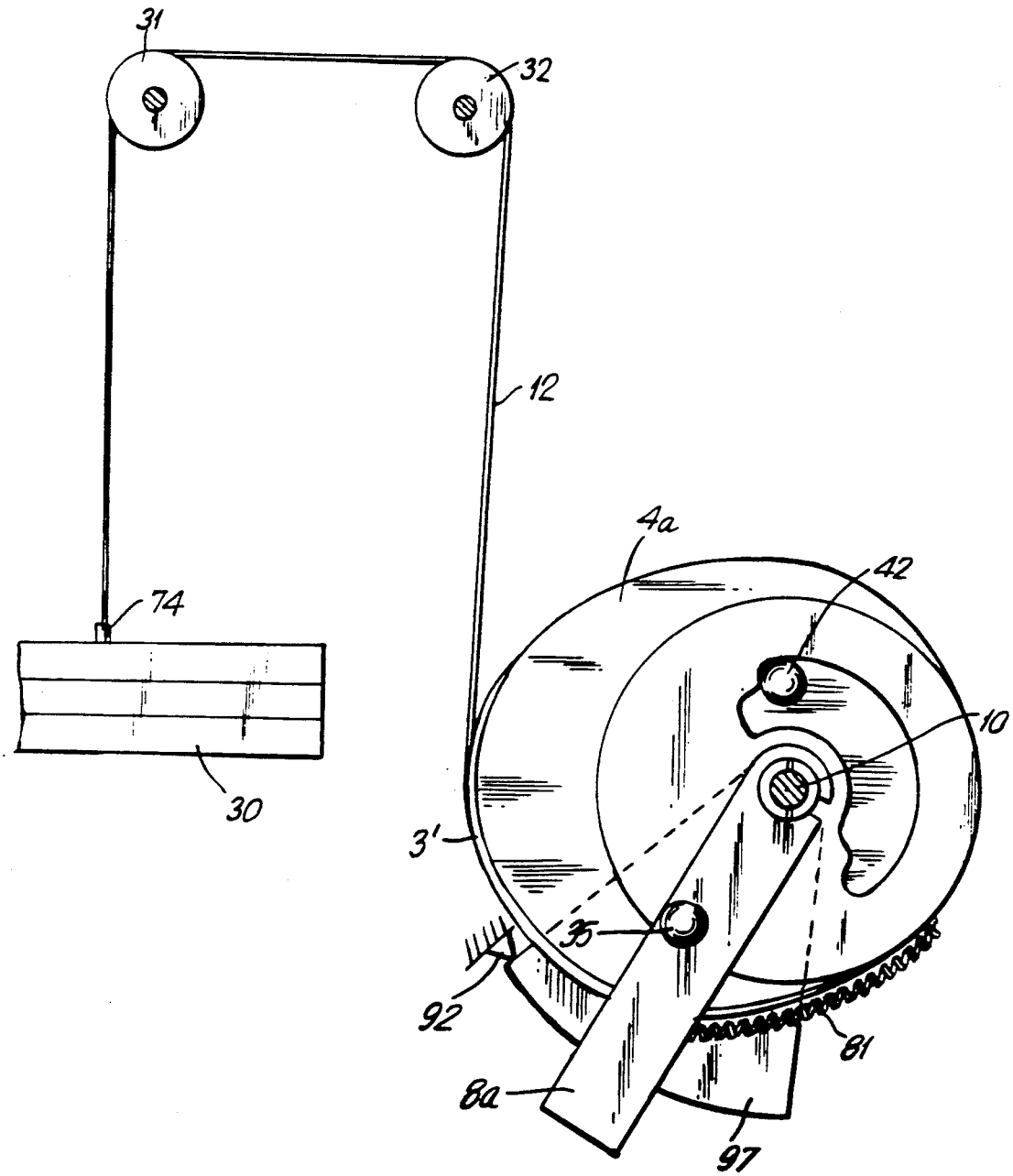
FIG. 18 shows a third embodiment of the range-limiter device.

In the FIGS. 16–17 device there is no 360° wrap of the cable 12 around the entire perimeter of the cam 4.

This FIGS. 16–17 embodiment uses knobs 35 and 42 as in the first embodiment with regard to changing the start and stop position for the range of motion. However, if the cam profile becomes too radical, i.e., changes in radius more than a few percent, then the rotation of the input assembly 19 and the cam 4 relative to the parallel arms 8 and 9 will result in the cable 12 being no longer tangent to the cam, as seen in FIG. 17.

The desired mechanical advantage of the cam profile will not be felt if the cable 12 is not tangent to the cam 4.

For the reasons stated above with respect to the FIGS. 1-12 device, a 360° wrap of the cable 12 around the perimeter of the cam 4 insures that the cable 12 will always be tangent, and eliminates the major problem associated with the FIGS. 16-17 embodiment.

Another way to insure that the cable 12 always departs the cam track 3 tangentially, other than by using the 360° cable wrap as shown in FIG. 3, is to reorient the second fixed stop 92 and the parallel arms 8 and 9 in relation to the input assembly 19 and the cam 4, as shown in dotted line in FIG. 17. Referring to FIG. 16, it is seen that the cable 12 is tangent to the cam track 3' at the point designated as 'y'. The distance from point 'y' to the center of rotation of the cam 4 is equal to the radius of the cam 4 at point 'y' and by definition that instantaneous radius is perpendicular to the cable 12 at point 'y'.

The location of the cable termination 13 within the cam follower 1' is represented by point 'x' on FIG. 16. If a line designated as 'z' is drawn through point 'x' parallel to the free length of cable 12, it is seen in FIG. 16 that line 'z' intersects the radial line from the center of rotation of the cam 4 to point 'y'. The distance from the center of rotation of the cam 4 to the point of intersection with line 'z' will be referred to below as the projected distance.

To insure that the cable 12 always departs tangentially from the cam track 3', the parallel arms 8 and 9, the cam follower 1', and the termination 13 of the cable 12 must be oriented in such a way that the projected distance between each possible point 'x' and the center of rotation of cam 4 is always less than the smallest radial distance from the center of rotation of cam 4 to the active perimeter of the cam. For purposes of determining the smallest radial distance from the center of rotation of the cam to its perimeter, the portions of the cam which are not used at all during any exercise or rehabilitation protocol, the so-called "inactive" portions of the cam, are not considered.

Making a reorientation of the arms 8 and 9 in relation to the input assembly 19 and the cam 4 results in an extremely convoluted shape for slot 6/7 if the shape of the cam is too radical, i.e. the cam profile changes more than a few percent. This make the machining of slot 6/7 very difficult and expensive and virtually non-functional.

The reason a radical cam profile makes the reorientation adjustment ineffective in the second embodiment is as follows.

In the case of the partial cable wrap of FIGS. 16-17, the parallel arms 8 and 9, the cam follower 1' and the cable termination 13 has to be located in such a way so to insure that the cable 12 will always depart the cam track 3' tangentially. The more radical the cam profile, the further away the cable termination 13 may be from this point of tangency.

In the situation of a partial cable wrap where there is a reorientation of the arms 8 and 9 relative to the cam 4, the change in the free length of the cable 12 has to be compensated for by the change in total length of the cable 12 in contact with the cam 4.

Since the cam follower 1' and cable termination 13 are relatively distant from the point of tangency, the error between the change in cable free length and the amount of compensation provided by the cable wrap is large, requiring large lateral swings in position of the cam follower 1' and the cable termination 13. This movement by the cam follower 1' is necessary to minimize the cable slack or tension resulting from the setting of a new start position. The overall effect on the shape of slot 6/7 is to include positional irregularities and sudden changes in direction, making the slot 6/7 virtually non-manufacturable as well as virtually non-functional.

As previously described, with any cam shape other than one with extremely gradual changes in radii within partial wrap, the shape of slots 6 and 7 become radical and non-functional. There does, however, exist an extremely complex way in which the concept of the partial cable wrap can be made to work. In simple terms, the cam track 3' can be divided into an active and non-active portion. The active portion is that portion of cam track 3' which is swept by cable 12 during the exercise or rehabilitation procedure. The change in radius of the active portion of the cam track 3' determines the change in mechanical advantage that the resistance mechanism has on the user and must be defined by the specific pattern being exercised. The non-active portion of the cam track 3', although possibly in contact with the cable 12, is not swept by the cable 12 during exercise and therefore does not affect the change of mechanical advantage experienced by the user.

As stated earlier, the cam profile works in synergy with the slots 6 and 7 profile to properly position the cam follower 1 and alleviate cable 12 slack or tension as required. If designed properly and if the cam follower 1 rides only over the non-active portion of the cam track 3', the non-active portion of the cam track 3' could be shaped in such a way as to minimize the occurrence of sudden irregularities in the shape of slots 6 and 7. Changing the shape of the non-active portion of cam track 3' has no affect on the mechanical advantage of the resistance mechanism on the user and the use of a partial wrap simplifies some of the structure. However, the calculations for the necessary shapes are extremely complicated.

Figure 16A:
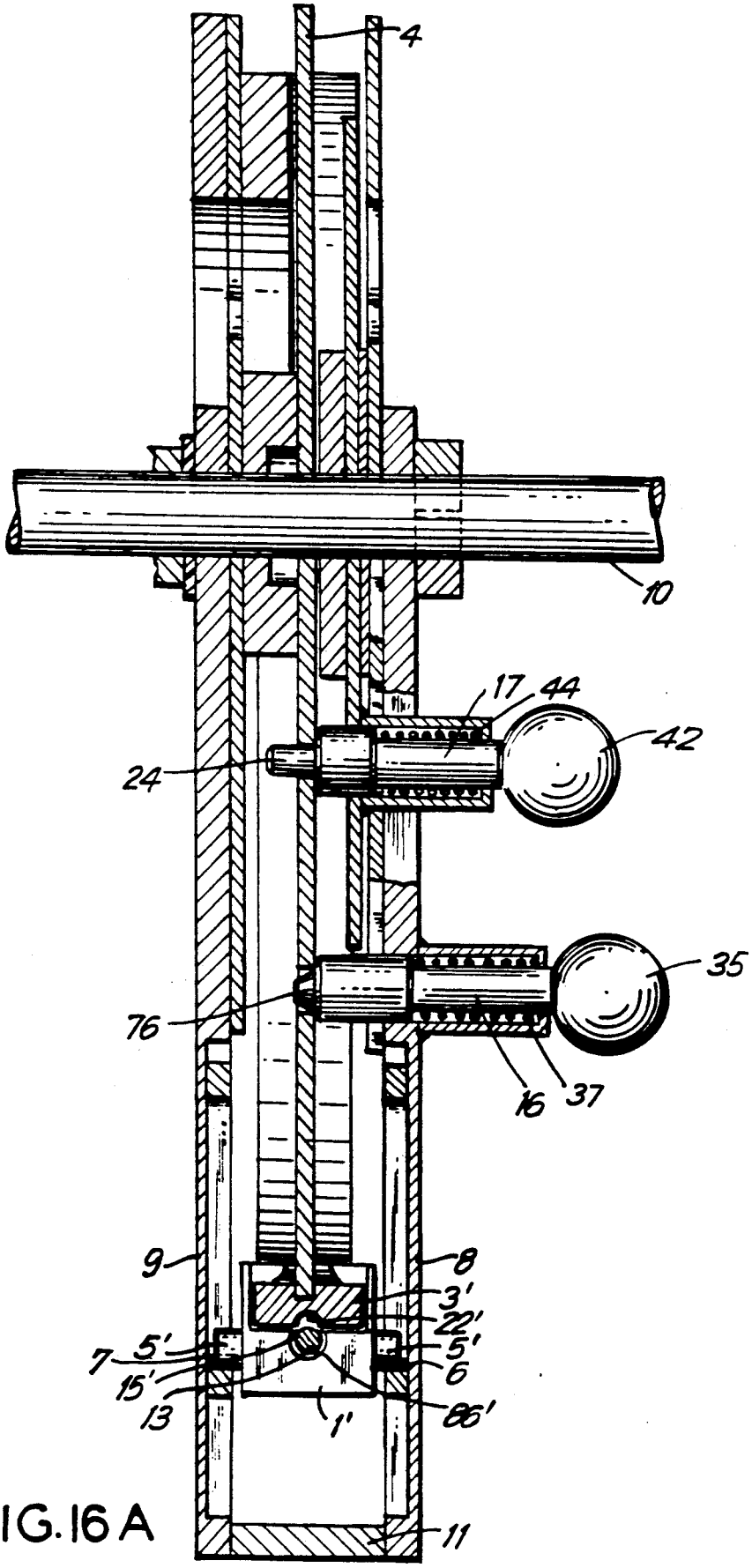
FIG. 16A is an enlarged edge view in elevation along lines A—A of FIG. 16.

As the profile of the cam becomes less radical, the embodiment shown in FIGS. 16, 16A and 17 becomes practical. This embodiment has the advantage over the FIGS. 1-12 embodiment in that it is simpler to construct.

A third embodiment of the device of the present invention is shown in FIGS. 18-22.

In those figures, the cam track 3' is the same as in the FIGS. 16, 16A embodiment, i.e., has a single groove 22' and does not extend around substantially around the entire perimeter of the cam.

Figure 19:
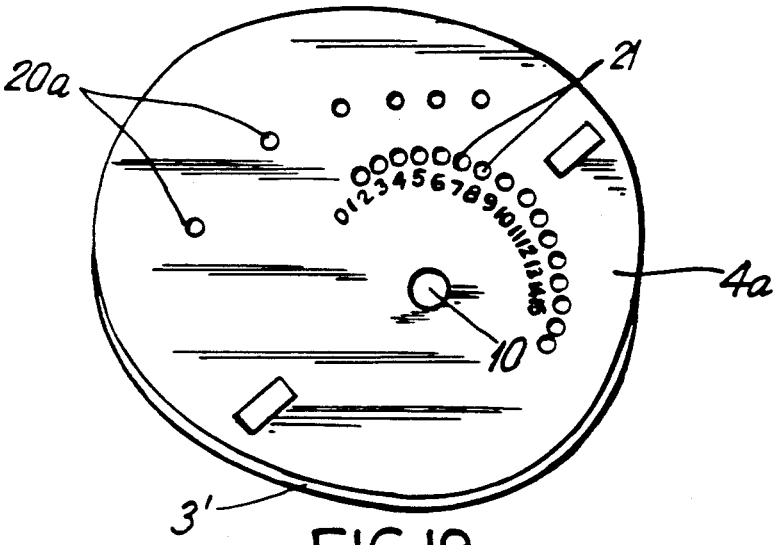
FIG. 19 is an isolated view in elevation of a cam of the device of the FIG. 18 embodiment.
Figure 20:
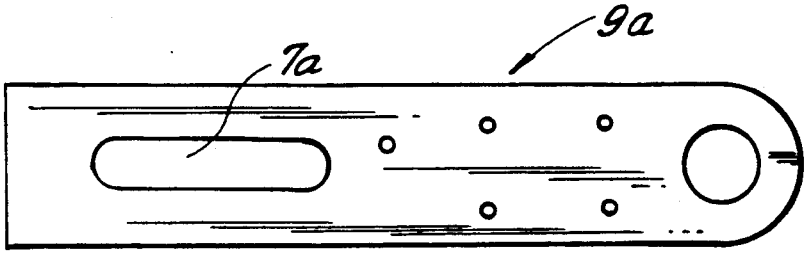
FIG. 20 is an elevated view in isolation of a first parallel arm of the device of the FIG. 18 embodiment.
Figure 21:
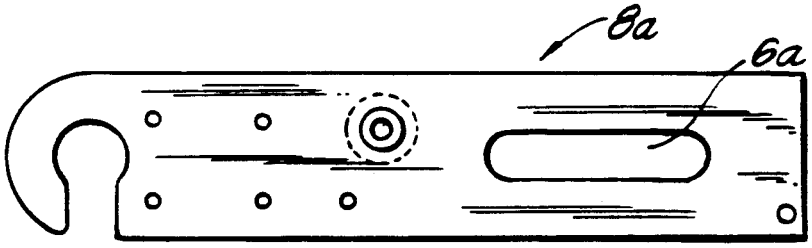
FIG. 21 is an elevated view in isolation of a second parallel arm of the device of the FIG. 18 embodiment.

The cam **4*a*, shown in FIG. 19, has outer holes 20*a* which are irregularly spaced from one another. Arms 8*a* and 9*a* shown in FIGS. 20 and 21, are similar to arms 8 and 9 in the preferred embodiment (FIGS. 4 and 10) except that the slots 6*a* and 7*a* are simple straight rectangular slots with semi-circular ends on the arms 8*a* and 9*a*. The sides of the slots 6*a* and 7*a* are parallel to the edges of the arms 8*a* and 9*a* and are centered relative to those edges. Since slots 6*a* and 7*a* have straight sides and no contours, cam follower 1', identical to the cam follower 1' shown in FIG. 16A, only rides in slots 6*a*** and 7a along a radial line from the center of rotation of the cam 4a.

Figure 22:
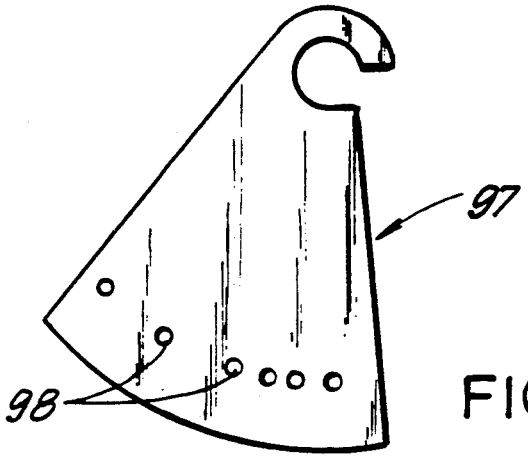
FIG. 22 is an elevated view of a subplate of the device of the FIG. 18 embodiment.

In the FIGS. 18-22 embodiment, a metal subplate 97 is rotatably mounted on the shaft 10 intermediate plate 38 and cam 4. (See FIG. 1) Subplate 97 has holes 98 therethrough as seen in FIG. 22. When subplate 97 is mounted on shaft 10, the holes 98 align with the outer set of holes 20a on cam 4a.

Subplate 97 rests at all times against first fixed stop 92. Stop 92 serves to prevent rotation of subplate 97 due to inertial effects.

A spring 81 is secured at a first end to the cam 4a by means of a screw or the like. The second end of spring 81 is secured to the cam follower 1' by any suitable means. In operation, subplate 97 is held against fixed stop 92. The end 76 of pull pin 16 engages both holes 98 in subplate 97 and companion holes 20a in cam 4a, locking the parallel arms 8a and 9a, cam follower 1', cable termination 13 and subplate 97 to the cam 4a. With pull pin 16 thus engaged in cam 4a, the system will function as any other variable-resistance weight machine.

When it is desired to select a new start position for the range of motion, force is applied against knob 35 overcoming the bias of spring 37. Retraction of pin 16 results in disconnecting the parallel arms 8a and 9a and all associated components from subplate 97 and cam 4a. Cam 4a and input assembly 19 are then free to rotate to a new start position. Upon reaching the new start position, the knob 35 is released allowing the spring 37 to force pin 16 to engage associated hole 98 in subplate 97 and one of the holes 20a in cam 4a.

As the cam 4a and input assembly 19 are rotated to a new start position, the free length varies. The change in free length must be compensated for by changing the total length of cable 12 in contact with the cam track 3'. The addition or subtraction of the length of cable wrap alone does not fully compensate for the change in cable free length. In the previous embodiments, the extra adjustment required was provided by the circumferential repositioning of the cable termination 13 by means of slots 6 and 7 in parallel arms 8 and 9, respectively, defining the location of cam follower 1. In the FIGS. 18-22 embodiment, slots 6a and 7a in parallel arms 8a and 9a are simply straight slots centered on and parallel to the centerlines of arms 8a and 9a, the slots 6a and 7a allowing the cam follower 1' to translate only radially in accommodation of the change of the radius of cam 4a.

To compensate for the error between the free length of cable 12 and the change in cable wrap resulting from setting a new start position, the spring 81 acts on cam follower 1' to force or allow cam follower 1', the cable termination 13, parallel arms 8a and 9a and associated components to rotate. Referencing FIG. 18, elements 1', 13 and 8a and 9a would rotate counterclockwise if there were any slack induced in the free length of cable 12. Alternatively, the spring 81 will allow rotation in the clockwise direction to alleviate any tension induced in the cable. The manner in which the cam follower 1' moves is not consistent, therefore requiring that holes 98 in subplate 97 and holes 20a in cam 4a be irregularly spaced. Proper spacing for holes 98 and 20a can be determined in a manner very similar to the empirical method for generating the shape of slots 6 and 7 described with regard to the FIGS. 1-12 embodiment.

The addition of subplate 97 and the requirement that holes 98 in subplate 97 and holes 20a in cam 4a be in perfect alignment to properly accept engagement of end 76 of pin 16, adds to the complexity of the device. However, the addition of subplate 97 is necessary in this embodiment to provide a constant surface to contact fixed stop 92 and eliminate potential inertial effects.

In the FIGS. 18-22 embodiment, the force of spring 81 must never be greater than the weight of the top weight plate of weight stack 30 or else spring 81 will lift the top plate when pin 16 is disengaged.

It is understood that the device of the present invention may be used on weight machines which do not offer variable-resistance to the user, such as machines where the cam is circular in shape and does not have a varying profile. Also, any weight loading means on the machine may be used to place a load on the input assembly. A weight stack on a selectorized weight machine has been discussed in the various embodiments for exemplary purposes only.

Our invention is not limited to the embodiments described above but is defined by the following claims.

We claim:

1. A range-limiter device for a weight machine, said machine having a frame, weight loading means and cable means attached at a first end to the weight loading means, the device comprising:
- a shaft supported on the frame of the machine, said shaft being free to rotate;
- a cam fixed to the shaft;
- an input assembly fixed to the shaft, the input assembly engaging the limbs of the user;
- a cam track mounted on at least a portion of the perimeter of the cam, the cam track having at least one groove for receipt of the cable means;
- cable supporting means comprising
  - a first parallel arm rotatably mounted on the shaft, the first parallel arm having a first slot in one surface thereof,
  - a second parallel arm rotatably mounted on the shaft, the second parallel arm having a second slot in one surface thereof, the second slot being of a mirror-image configuration to the first slot, the first and second parallel arms being mounted on the shaft on either side of the cam,
  - first attaching means for attaching the first parallel arm and the second parallel arm in parallel relation,
  - a cam follower captured in the first and second slots, a bottom portion of the cam follower surrounding the cam track, and
  - second attaching means for attaching a second end of the cable means to the cam follower, wherein the cam follower rides in the first and second slots when the input assembly and the cam are rotated to the new start position for the range of motion; and
- second connecting means for connecting the cable supporting means to the cam, wherein to adjust the start position in the range of motion, the user disconnectes the cable supporting means from the cam, rotates the input assembly and the cam to the desired start position and then reconnects the cable supporting means to the cam.

2. The device of claim 1 wherein the first connecting means comprises:
- a first pull pin;
- means for mechanically connecting the first pull pin to the first parallel arm;
- a first set of holes in the cam, wherein the first and second parallel arms are connected to the cam by engaging the first pull pin in one of the first set of holes in the cam.

3. The device of claim 2 wherein an end of the pull pin engaged in one of the first set of holes in the cam is tapered.

4. The device of claim 3 also comprising:

a subplate rotatably mounted intermediate the first parallel arm and the cam, the subplate having a third set of holes irregularly spaced from one another; and a spring attached at a first end to the cable supporting means and at a second end to a point on the perimeter of the cam, wherein the first set of holes on the cam are aligned with the third set of holes in the subplate and the first pull pin is engaged through aligned holes in the subplate and the cam.

5. The device of claim 4 also comprising means for adjusting the stop position for the range of motion, said means comprising:

an inside plate rotatably mounted on the shaft intermediate the first parallel arm and the cam;

a second pull pin;

means for mechanically connecting the second pull pin to the inside plate;

a second set of holes in the cam, wherein the second pull pin is engaged in one of the second set of holes in the cam;

a first fixed stop attached to the frame of the machine, wherein an end of the second pull pin hits the first fixed stop at the desired stop position for the range of motion, and wherein the adjustment of the stop position for the range of motion is done by disengaging the second pull pin from one of the second set of holes in the cam, rotating the inside plate to a new desired stop position, and reengaging the second pull pin in one of the second set of holes in the cam.

6. The device of claim 5 also comprising a scale marking on the cam for the second set of holes and a window on the inside plate for viewing the scale marking.

7. The device of claim 6 also comprising a first cover plate rotatably mounted on the shaft intermediate the first parallel arm and the inside plate, the first cover plate having an arcuate slot through which the second pull pin extends, the first cover plate also having a notch on an exterior surface thereof providing clearance for the first pull pin.

8. The device of claim 7 also comprising a second cover plate rotatably mounted on the shaft intermediate the cam and the second parallel arm, the second cover plate having an arcuate slot therein for receipt of the first fixed stop;

a first counterbalance weight;

means for attaching the first counterbalance weight to the second cover plate for counterbalancing the weight of the first and second parallel arms.

9. The device of claim 8 wherein each of the first set of holes on the cam are evenly spaced from one another and define a first arc on the cam.

10. The device of claim 9 also comprising means for preventing rotation of the cam relative to the first parallel arm beyond the arc defined by the first set of holes on the cam.

11. The device of claim 10 wherein each of the second set of holes on the cam are evenly spaced from one another and define a second arc on the cam.

12. The device of claim 11 also comprising means for preventing rotation of the inside plate relative to the cam beyond the arc defined by the second set of holes on the cam.

13. The device of claim 12 also comprising an end fitting having a diameter greater than the diameter of the cable means, means for attaching the end fitting to the second end of the cable means, the cam follower including:

first and second cylindrical cam-follower features which are captured in the first and second slots in the first and second parallel arms;

a first hole for receipt of the second end of the cable means; and a countersink surrounding a substantial portion of the first hole, the countersink having a diameter slightly greater than the diameter of the end fitting attached to the second end of the cable means.

14. The device of claim 13 wherein the first and second cam-follower features and the first hole in the cam follower share a common centerline.

15. The device of claim 14 wherein the bottom portion of the cam follower has first and second L-shaped sections, said L-shaped sections surrounding the cam track on the cam.

16. The device of claim 15 wherein the cam follower has a longitudinal slot in which the cable means travels.

17. The device of claim 16 wherein the first and second parallel arms are made of aluminum;

a first steel contoured insert;

means for attaching the first insert in the first slot in the first parallel arm;

a second steel contoured insert;

means for attaching the second insert in the second slot in the second parallel arm, the first and second steel contoured inserts being of a mirror image configuration to one another.

18. The device of claim 17 also comprising a second fixed stop attached to the frame of the machine wherein the first and second parallel arms rest against the second fixed stop for all start positions in the range of motion and the second fixed stop prevents rotation of the first and second parallel arms due to inertial effects of the machine.

19. A range-limiter device for a weight machine, said machine having a frame, weight loading means and cable means attached at a first end to the weight loading means, the device comprising:

a shaft supported on the frame of the machine, said shaft being free to rotate;

a cam fixed to the shaft;

an input assembly fixed to the shaft, the input assembly engaging the limbs of the user;

cable supporting means;

first connecting means for connecting a second end of the cable means to the cable supporting means;

second connecting means for connecting the cable supporting means to the cam, wherein to adjust the start position in the range of motion, the user disconnects the cable supporting means from the cam, rotates the input assembly and the cam to the desired start position and then reconnects the cable supporting means to the cam; and a cam track mounted on at least a portion of the perimeter of the cam, wherein the cam track has a first groove and a second groove and the cable means wraps partially around approximately one-half the perimeter of the cam in the first groove of the cam track and then wraps around the rest of the parimeter of the cam in the second groove of the cam track.

20. The device of claim 19 also comprising an anti-friction coating applied to the first and second grooves on the cam track.

21. A range-limiter device for a weight machine, said machine having a frame, weight loading means and cable means attached at a first end to the weight loading means, the device comprising:

a shaft supported on the frame of the machine, said shaft being free to rotate;

a cam fixed to the shaft;

an input assembly fixed to the shaft, the input assembly engaging the limbs of the user;

cable supporting means;

first connecting means for connecting a second end of the cable means to the cable supporting means;

second connecting means for connecting the cable supporting means to the cam, wherein to adjust the start position in the range of motion, the user disconnects the cable supporting means from the cam, rotates the input assembly and the cam to the desired start position and then reconnects the cable supporting means to the cam; and receiving means for the receipt of the cable means whereby the cable means is wrapped at least 360° around the perimeter of the cam in the receiving means and wherein that portion of the cable means that is wrapped around the perimeter of the cam is continuously in contact with the perimeter of the cam and wherein the receiving means comprises a cam track mounted on the perimeter of the cam having a first groove and a second groove wherein the cable means wraps partially around approximately one-half the perimeter of the cam in the first groove of the cam track and then wraps around the remaining portion of the perimeter of the cam in the second groove of the cam track.

* * * * *